US005487649A

United States Patent [19]

Dorsey, III et al.

[11] Patent Number: 5,487,649

[45] Date of Patent: Jan. 30, 1996

[54] INFINITELY VARIABLE PNEUMATIC PULSATILE PUMP

[75] Inventors: James H. Dorsey, III, Lighthouse Point, Fla.; Joe E. West, Meridian, Tex.

[73] Assignee: American Hydro-Surgical Instruments, Inc., Delray Beach, Fla.

[21] Appl. No.: 128,850

[22] Filed: Sep. 29, 1993

[51] Int. Cl.[6] ..... F04B 45/00; A61M 1/00

[52] U.S. Cl. ..... 417/395; 417/426; 604/153

[58] Field of Search ..... 417/384, 379, 417/394, 395, 426, 46; 604/153

[56] References Cited

U.S. PATENT DOCUMENTS

| | | | |
|---|---|---|---|
| 4,662,829 | 5/1987 | Nehring | 417/395 |
| 4,741,678 | 5/1988 | Nehring | 417/395 |
| 4,782,817 | 11/1988 | Singh et al. | 600/17 |
| 4,844,706 | 7/1989 | Katsuyama et al. | 417/395 |
| 4,856,969 | 8/1989 | Forsythe et al. | 417/395 |
| 4,872,813 | 10/1989 | Gorton et al. | 417/63 |
| 4,941,872 | 7/1990 | Felix et al. | 604/27 |
| 4,957,491 | 9/1990 | Parker | 604/317 |
| 4,973,311 | 11/1990 | Iwakoshi et al. | 604/119 |
| 5,006,050 | 4/1991 | Cooke et al. | 417/478 |
| 5,062,774 | 11/1991 | Kramer et al. | 417/413 |
| 5,071,419 | 12/1991 | Rydell et al. | 606/48 |
| 5,098,377 | 3/1992 | Borsanyi et al. | 604/30 |
| 5,098,387 | 3/1992 | Wiest et al. | 604/153 |
| 5,108,367 | 4/1992 | Epstein et al. | 604/67 |
| 5,125,891 | 6/1992 | Hossain et al. | 604/34 |
| 5,127,907 | 7/1992 | Coutré et al. | 604/151 |
| 5,131,816 | 7/1992 | Brown et al. | 417/2 |

*Primary Examiner*—Richard A. Bertsch
*Assistant Examiner*—William Wicker
*Attorney, Agent, or Firm*—Malin, Haley, DiMaggio & Crosby

[57] ABSTRACT

A pulsatile pump the output of which is infinitely variable between a slow pulsatile flow and increased up to a sharply pulsed flow rate until the pulses run together and a smooth flow results, and which may be varied between wide output pressure and frequency limits. The pump is comprised of a pneumatic control circuit, at least two pneumatically isolated compression chambers, and a novel inlet/outlet pump cartridge and condition-responsive locking means. Operation of the pump is controlled by the use of novel tactile pneumatic response switches. Each compression chamber is communicated with a supply of working fluid through the cartridge. Means are provided for varying the operation of the pneumatic circuit and hence the pump. A flow of pressurized fluid, such as air or nitrogen, is used as the operating media of the pneumatic circuit, although other fluids may be used. Means for monitoring and adjusting pump system parameters are also provided. The pump operates entirely through the use of pneumatic energy, avoiding the use of electricity.

20 Claims, 31 Drawing Sheets

INFINITELY VARIABLE PNEUMATIC PULSATILE PUMP

BACKGROUND OF THE INVENTION

1. Field of the Invention

This invention relates to an air-driven, infinitely variable, pneumatic pulsatile pump for discharging working fluid and, more particularly, relates to a pneumatic pulsatile pump which employs at least two pneumatically independent pumping bladders and a unique pneumatic control circuit which, among other things, permits convenient adjustment from a sharply pulsed flow to a continuously smooth flow through a simple manual adjustment by the user during operation of the pump.

2. Description of the Prior Art

There exist serious shortcomings in the field of fluid pumps, both of the pulsating type and of the smooth-flow (continuous) type. One of the major disadvantages inherent in state of the art pumps is the inability of the user of such pump to vary the flow rates, pressures, and pulsation frequency of the discharging, or working, fluid among a virtually infinite number of settings within a predetermined and controllable range of discharge flow conditions. One area in which this problem is particularly acutely felt is in the surgical field of procedures such as laparoscopy, in orthopedic procedures, and also procedures such as open surgery where a pressurized irrigation fluid is directed through a probe onto the operative surgical site and field to effect removal and debridement of a target tissue and debris. Alternating use of irrigation and suction and simultaneous use of suction and irrigation effects removal of the infused working fluid endogenous to the operative field, and any tissue, blood, char, or debris that has been hydraulically displaced. If the laparoscopist can select the pressure and control the pulse frequency of the working fluid to within close or exact tolerances, the quality of the procedure will be enhanced via these advantages and also through the utilization of the force of the fluid to hydro-dissect tissue planes which separate organs and structures in the body by dissecting these plains via the fluid displacing them at their path of least resistance.

Recent advances in laparoscopic surgical techniques have been numerous. Laparoscopy has now become the procedure of choice for many surgical procedures, and specifically, has become the norm for the removal of the diseased gallbladder (cholecystectomy). Initially, the instrumentation for laparoscopic procedures was archaic and makeshift, borrowed from previously developed gynecological laparoscopic procedures. Recently there have been significant improvements in this instrumentation due to its unprecedented surgical acceptance. One of the recent advancements involves equipment designed for the aspiration and irrigation of working fluid.

The various uses for aspiration and irrigation of fluid include dissection of tissue plains and structures using aqueous solutions, aspiration, rinsing/lavage for enhanced visualization of the surgical site, suction-retraction, blunt dissection, blood clot, tissue removal and debridement, gallstone extraction, and the evacuation of smoke. This diversification of needs makes it imperative that a suction/irrigation system be versatile enough to accomplish any and all tasks.

Of the pulsating irrigation systems presently in use, one such device is disclosed in U.S. Pat. No. 4,741,678 to Nehring, which utilizes a single bladder chamber and, consequently, a limited pulse frequency adjustment. Since only one pump chamber is employed, this pump operates in only a limited range of outputs. In addition, the Nehring device does not incorporate an automatic means for relieving the pressure in the discharge media when flow is terminated. That is to say, when the point-of-use instrument, e.g. laparoscopy probe, is placed in a non-flow state, the discharge media on the upstream side of the instrument remains at an elevated pressure. Since it is desired that no accidental leakage be permitted to occur in most settings where irrigation is performed, the pressurized condition of the discharge media is undesired. None of the pumps heretofore employed have means for virtually instantaneously terminating the flow through the point-of-use instrument while simultaneously reducing the pressure of the discharge media to near ambient.

A representative example of an electrically operated pump is disclosed in U.S. Pat. No. 4,650,462 to DeSatnick et al., which discloses a single source irrigation system. Reliance on electrical energy is undesirable for a variety of reasons, among them, introducing an electrical pumping device in the environment of an operating room and reliance of electronic circuitry and feedback to control and monitor pressures, flows, pulsations, and on/off sensing; the danger of introducing electrical potential in an environment where pure oxygen is present; and the incompatibility of electrical power supplies and required approvals in different countries.

Yet another example of a pneumatic pump is the CODIP tubular diaphragm sold by Warrender, Ltd., Northbrook, Ill., which utilizes a single cylindrical diaphragm and pump housing. This device likewise does not utilize more than one pumping diaphragm and, hence, cannot provide a smooth flow if desired. None of these or any other systems known to the inventors provide a plurality of commonly controlled pneumatically independent pumping bladders which allow for virtually infinite variation of fluid flow pressure and pulse frequency.

Other fluid pumps used in surgical applications such as laparoscopy have relied on saline bottles as a fluid supply reservoir which are pressurized with compressed gas to create flow. Bottles, however, are either not equipped with or rely on floating check valves which may be prone to intermittent or total failure. Failure of these check valves can have negative safety consequences should gas suddenly be emitted from the pump discharge into the patient's abdominal cavity.

A need exists in the field of pulsatile pumps for an easy-to-use, reliable, and versatile pump, the output of which can be infinitely varied between wide limits, with both pressure and pulse frequency independently variable, and which also can produce continuous flows and incorporates a discharge media venting means and user-friendly controls. The instant invention has been developed primarily, though not exclusively, with a view toward achieving the aim of creating a device of the above type with which a user can perform a dynamic range of fluid flow control and irrigation operation in a safe and secure manner.

SUMMARY OF THE INVENTION

To carry out the principles of the invention, there is provided a pulsatile pump the output of which is infinitely variable between a slow pulsatile flow and increased up to a sharply pulsed flow rate until the pulses run together and a smooth flow results, and which may be varied between wide output pressure and frequency limits. The pump is comprised of a pneumatic control circuit, at least two pneumatically isolated compression chambers, and a novel inlet/outlet pump cartridge and condition-responsive locking means. Operation of the pump is controlled by the use of novel tactile pneumatic response switches. Each compression chamber is communicated with a supply of working fluid through the cartridge. Means are provided for varying the operation of the pneumatic circuit and hence the pump. A flow of pressurized fluid, such as air or nitrogen, is used as the operating media of the pneumatic circuit, although other fluids may be used without departing from the scope of the invention. Means for monitoring and adjusting pump system parameters are also provided. The pump operates entirely through the use of pneumatic energy, avoiding the use of electricity.

In accordance with a preferred embodiment of the invention, an adjustable pulsatile pump is provided, comprised of a pneumatic circuit in which a series of high speed condition-responsive pilot valves are sequentially switched after selectively variable time intervals in dependence on the position of a series of high speed on/off switches, fixed flow restrictors, and the adjustment of a variable flow restrictor. The switches are used to selectively supply or deprive the pneumatic circuit with pressurized operating media from a supply thereof. The switching of the pilot valves is passive, i.e. condition-responsive, while control of the on/off switches is primarily manual. The pilot valves are interconnected with the on/off switches in such a way that the oscillation of the pilot valves is variable. The lapse time between charging of each compression chamber may be varied manually so as to alter the flow quality of the working fluid. The oscillatory output of the pneumatic circuit is also dependent on an arrangement of fixed-diameter orifi associated with the pilot valves.

The system or reference pressure of the pneumatic circuit can be varied so as to change the working capability, i.e. pressure potential, of the pump. When the working fluid discharge pressure drops below the operator selectable reference pressure, the pump automatically commences operation and flow.

The pneumatic circuit feeds a pair of pneumatically independent compression chambers, each chamber housing an impervious bladder or diaphragm therein, each adapted to receive and/or eject a quantity of working fluid such as saline solution through a common discharge port in the cartridge to a point-of-use instrument. Depending upon whether irrigation or suction would be required, respectively, the device could also be utilized for suction via reversing the input and outputs.

Simple, manual, push-button actuation of either one of a pair of working fluid supply switches may be made to utilize either the first or second supply of working fluid through an inlet chamber of the cartridge, and an additional button may be utilized to simultaneously utilize both sources. Another manual push-button adjustment of another of the on/off switches may be made to change the flow quality from a sharply pulsed (square wave) flow to a continuously pulsing (saw tooth) flow, or vice versa.

The pump also includes means for positively terminating the flow of working fluid on demand as, for example, when the pump is turned off and when the point-of-use instrument placed in a non-discharge mode.

The cartridge is held in its operational position while the pump is energized by way of a locking/unlocking means which is controlled directly by the pneumatic circuit itself. When the pump is de-energized (i.e. switched off), the locking means is likewise de-energized so as to permit the removal of the cartridge and pump bladders prior to installation of a new cartridge and pump bladders for the next operation. When the locking means is de-energized, means are provided for venting pressure in the working fluid downstream of an outlet chamber in the cartridge to near ambient. When the pump is energized, but the point-of-use instrument closed, such that discharge media is not flowing out of the discharge orifice defined by the cartridge, the pilot valves of the pneumatic circuit are deprived of operating media so that additional pressure is not supplied to the pump chambers. When the pump is energized and flow of discharge media is permitted through the point-of-use instrument, means is provided for energizing the pilot valves of the pneumatic circuit so that pressurized air is supplied, in the order selected, to the compression chamber(s).

The locking means is comprised of a double piston arrangement reciprocally movable between a locked position in engagement with the cartridge housing and a sensing diaphragm connected to the cartridge and an unlocked position out of engagement with the cartridge housing and diaphragm. The position of the locking piston is responsive to the pump being turned on or off. A single source of pressurized operating media such as air is used to operate all features of the pump, eliminating the need for multiple sources of power, which in turn reduces the maintenance factor of the system dramatically.

The pump of the instant invention is extremely compact, versatile and portable. Further, the working parameters of the pump can easily be varied by increasing or decreasing the system pressure. This changes the system reference pressure so as to modulate the pressure at which the system will shut down. The pneumatic logic of the system is designed so that working fluid is discharged from one or both of two bladders, selectively, to provide the desired flow. Since the bladders are not mechanically linked together and the chambers may be independently and variably pressurized, the discharge stream of fluid can be varied almost infinitely.

The pump could also be utilized with a modified cartridge to provide, alternatively, positive and/or negative pressures by, for example, using one bladder for positive and the other for negative pressure. Additional bladders may be employed to enhance the performance of the pump as desired.

Due to the shortcomings present in prior art pump systems, it is a principle object of the instant invention to provide an improved pump.

It is also an object of the instant invention to provide a pulsatile pump having means for varying the flow quality of the discharging working fluid.

It is a further object of the present invention to provide a pump which provides a variable pulsed or smooth-flow output which can be conveniently controlled by a novel pneumatic circuit and user adjusted operating settings.

It is a still further object of the present invention to provide a pump using pneumatic logic to control at least two displacement compartments in such a manner of timing as to achieve a smooth, non-pulsed, flow of liquid at the discharge end if desired.

It is an even further object of this invention to provide a pump that employs a pump cartridge with a pressure-sensing membrane to obtain a feedback signal which causes the pump to be placed in a standby mode where discharge of working fluid is terminated.

It is also an object of this invention to provide a pump where the position of the sensing membrane is responsive to pressure in the working fluid output line, and by such response leads to the operation of the pump being either terminated or commenced.

It is a still further object of this invention to provide a pump which employs a pneumatic logic circuit that compares the pressure within the discharge media to the reference pressure of the operating media of the pump in such a way as to modulate the output of the pump between flow and no flow conditions and any condition therebetween.

It is a still further object of this invention to provide a pump with at least two displacement compartments which are not mechanically connected, wherein a pneumatic logic circuit is used to, in one flow mode, vary the cycle time for filling one displacement compartment to less than 50% of the cycle time for discharging from the other displacement compartment to allow an overlap in the ejection of discharge media from sequential displacement bladders, wherein at least one such displacement bladder can be caused to eject flow of discharge media at all times during which the pump is operating.

In accordance with these and other objects which will be apparent hereinafter, the instant invention will now be described with particular reference to the accompanying drawings. The drawings constitute a part of this specification, and include exemplary embodiments of the present invention and illustrate various objects and features thereof.

DESCRIPTION OF THE PREFERRED EMBODIMENTS

Figure 1:
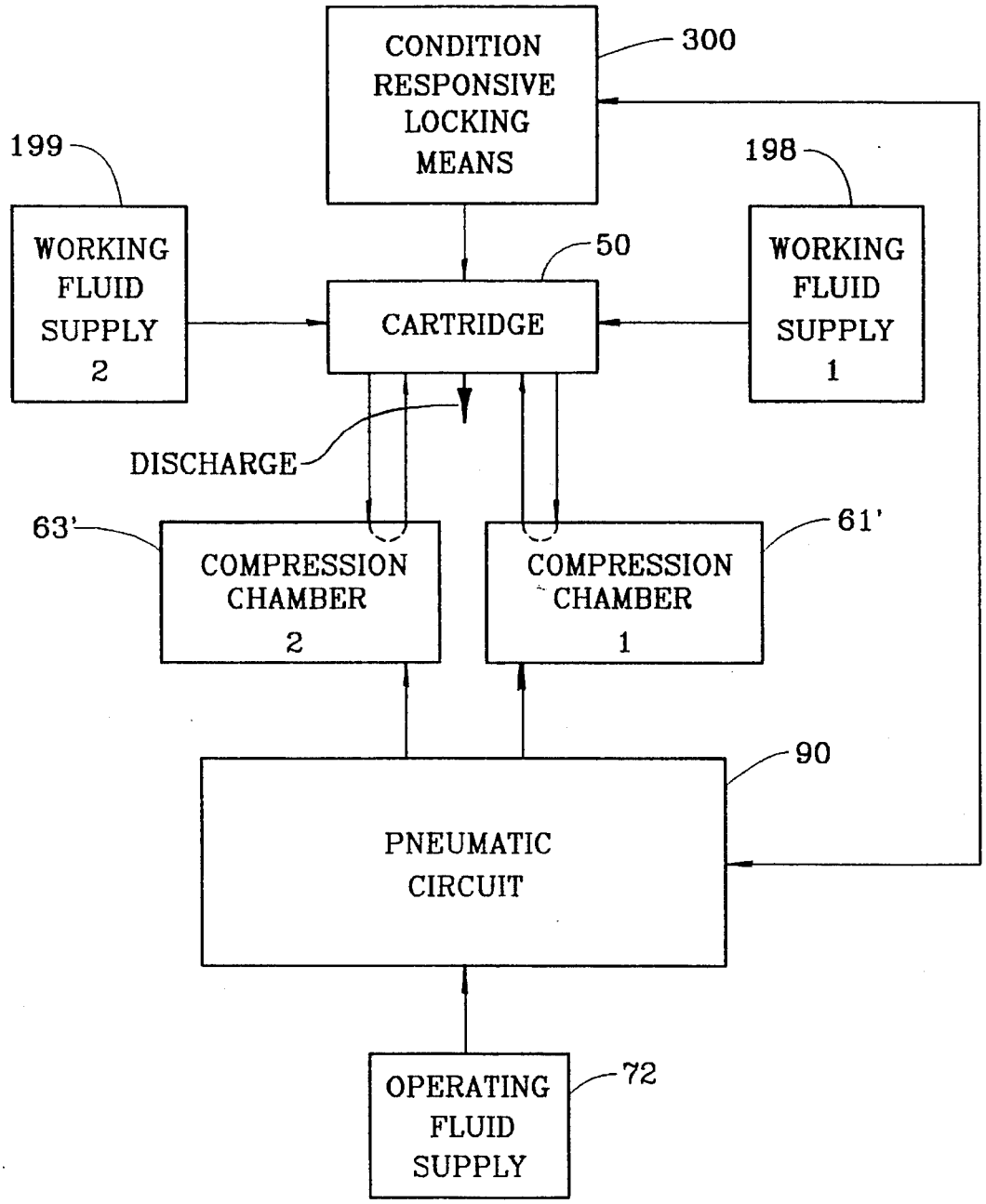
FIG. 1 is a schematic representation of the pulsatile pump and system of the present invention.
Figure 2:
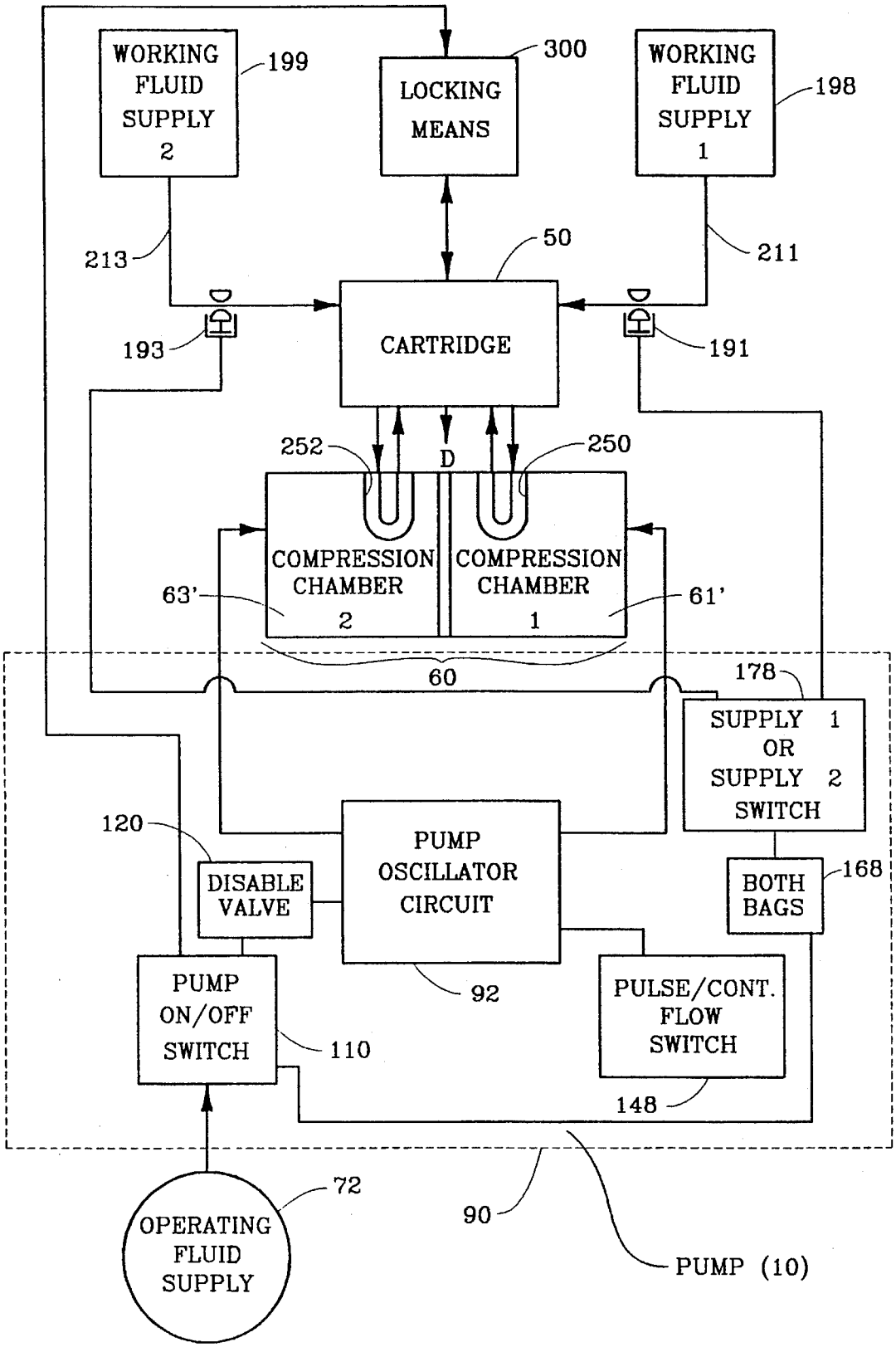
FIG. 2 is a more detailed schematic representation of the pulsatile pump and system of this invention.

Referring now to the drawings, FIGS. 1 and 2 provide a schematic representation of the structural and functional arrangement of the invention, for which greater detail is set forth below. FIG. 1 illustrates the overall configuration of the invention, which includes an oscillatory control system embodied in a pneumatic circuit 90 supplied with an input signal $P_1$ in the form of a flow of compressed operating fluid from a supply 72 thereof. As specified above, the operating fluid employed with the pneumatic circuit 90 is preferably compressed air, but may be any other fluid suitable for use with a pneumatic circuit of the type disclosed herein. Pneumatic circuit 90 provides a signal (flow of pressurized operating fluid) to a condition-responsive locking means 300, and intermittently and selectively charges first and second compression chambers 61', 63'. Charging of said compression chambers causes working fluid from first and second working fluid supplies 198, 199, respectively, to be emitted through a novel pump cartridge through the use of first and second pump bladders associated with compression chambers 61', 63'.

FIG. 2 provides a more detailed overview of the invention, wherein pneumatic circuit 90 is comprised of a pump oscillatory subcircuit 92, pump on/off switch 110, oscillatory subcircuit disable valve 120, pulse/continuous flow switch 148, and working fluid supply selection switches 168 and 178. Oscillator circuit 92 is used to continuously and adjustably switch between charging compression chambers 61' and 63'. Working fluid supplies 198, 199 are communicated with pump cartridge 50 via conduit means 211, 213, respectively. Conduit crimping arrangement 191, 193 may be employed to selectively interrupt working fluid supply through conduits 211, 213, respectively, in dependence on the position of working fluid supply selection switches 168, 178. A bladder housing body member 60 is comprised of a pair of bladder housings 61, 63, which define first and second compression chambers 61', 63', respectively, and which are intermittently and selectively supplied with pressurized operating fluid from pump oscillatory circuit 92.

Figure 3A:
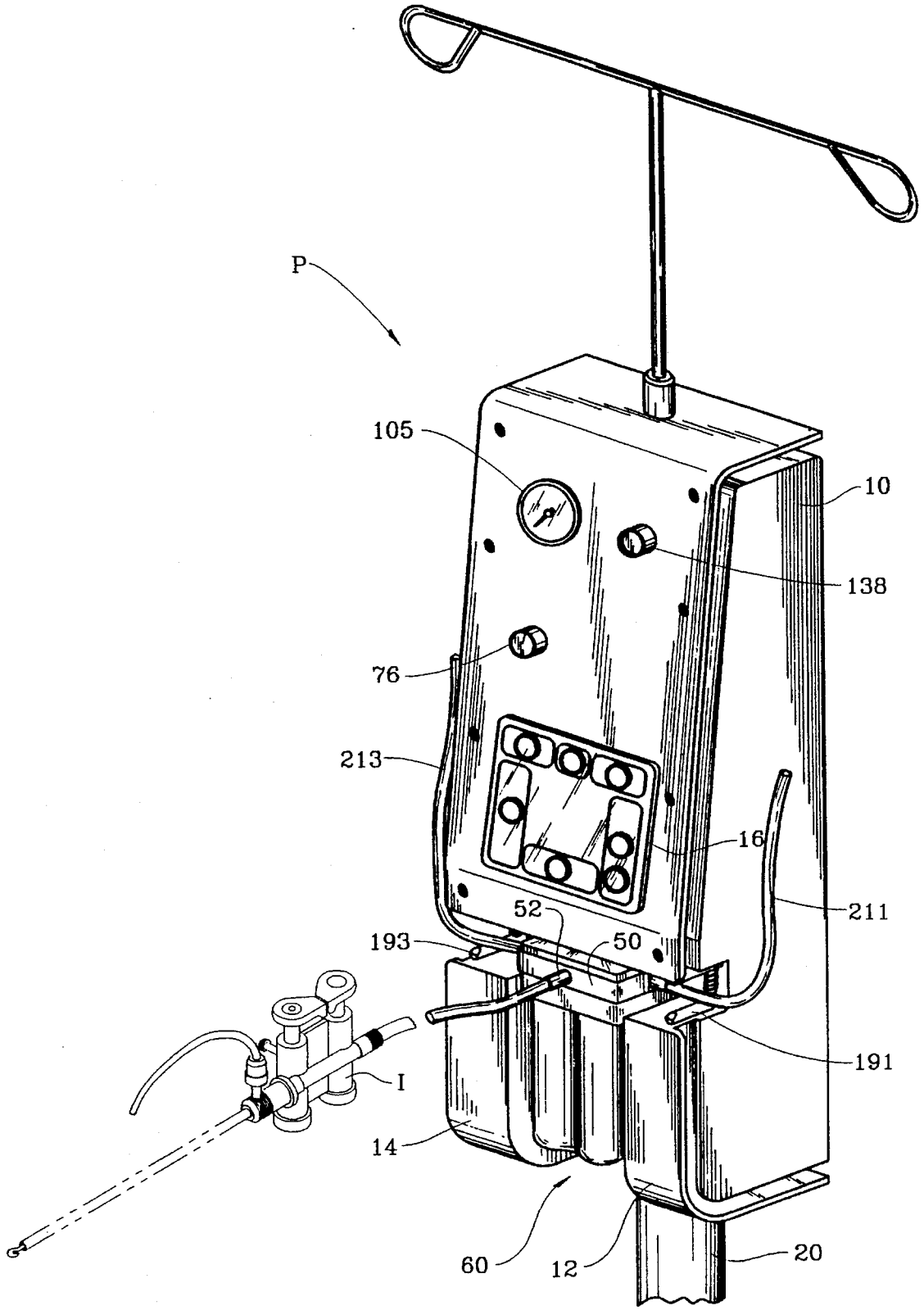
FIG. 3A is a perspective view of the invention.
Figure 3B:
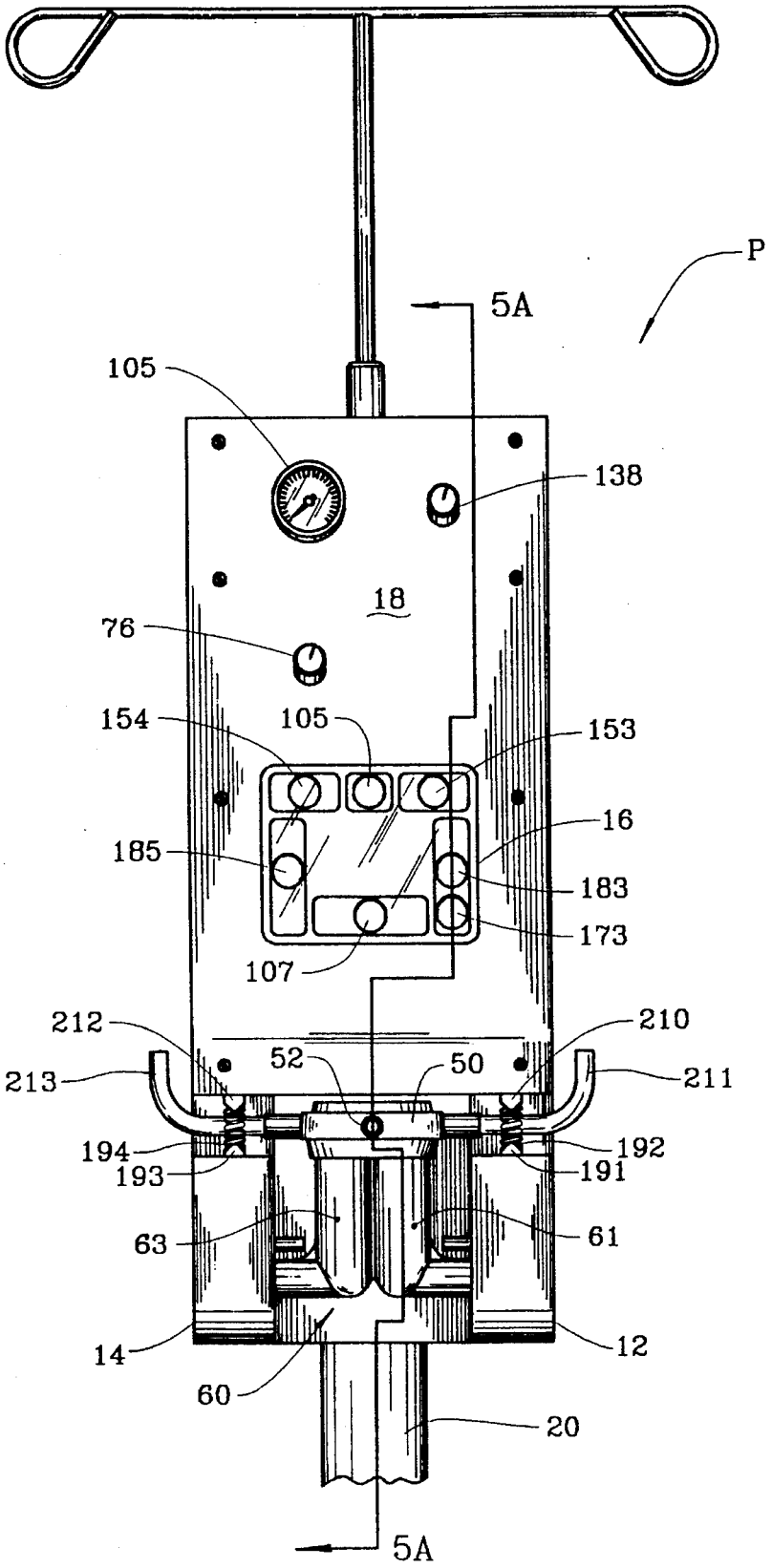
FIG. 3B is a front elevational view of the invention shown in FIG. 3A.

FIGS. 3A and 3B depict the preferred embodiment of an assembled pump P, which is comprised generally of a housing 10 supported by a stand 20. Stand 20 may be connected at its bottom end to a base (not shown), which may or may not be provided with means for rolling such as wheels or casters (not shown). Housing 10 encompasses a pneumatic circuit 90, shown in FIGS. 4A through 4F, and a locking/unlocking means 300, depicted in FIGS. 5B, 5C, 5D, and 6A–6D. Operatively associated with the foregoing is an inlet/outlet pump cartridge 50 and a bladder housing 60 defining a pair of pneumatically independent pressurization or pump chambers 61', 63' supported between housing trunions 12, 14. A plurality of manual switches 110, 148, 168, and 178, depicted in FIG. 2, for controlling pump P communicate the pneumatic circuit 90 with an operator. The switches are, preferably but not by way of limitation, controlled by tactile switches generally shown in FIG. 21, which will be described hereinafter.

FIGS. 4A–4F show schematically the overall system of the instant invention. Turning now to FIG. 2, the system is comprised of three interconnected elements: (1) a pneumatic circuit designated generally by the reference numeral 90; (2) an inlet/outlet pump cartridge 50; and (3) a cartridge locking/unlocking arrangement 300. An oscillatory pneumatic subcircuit 92 and an oscillatory subcircuit disable valve 120, which are both a part of circuit 90, is also shown.

In FIGS. 4A–4F, pneumatic circuit 90 is comprised of a series of condition-responsive switches 120, 130, 140, and 160, operatively interconnected, manual switches 110, 148, 168, and 178, which are likewise interconnected, and a plurality of flow restrictors.

Figure 13:
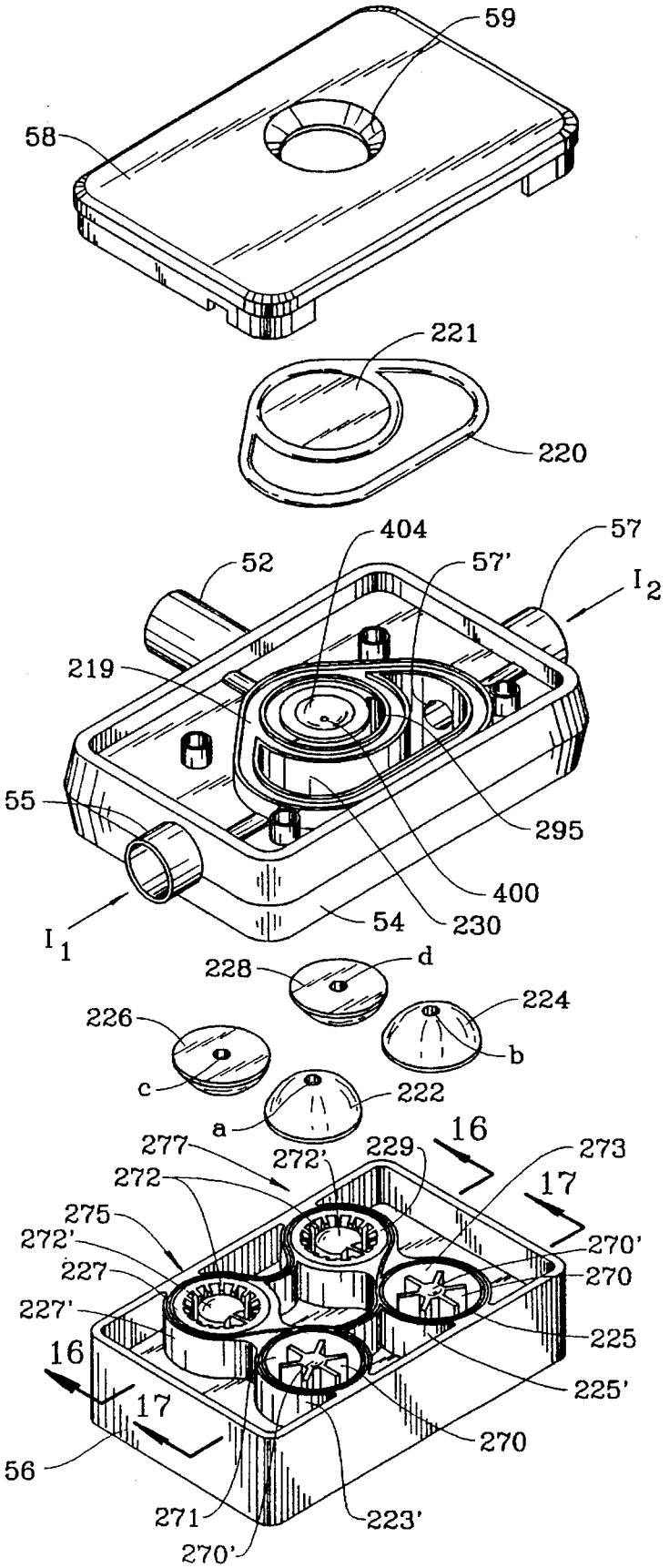
FIG. 13 is a perspective exploded view of the pump cartridge of the instant invention.
Figure 20:
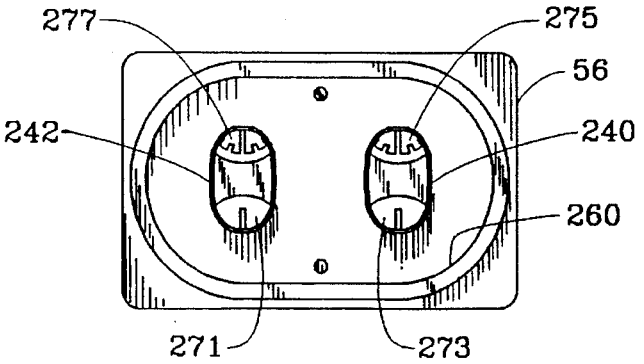
FIG. 20 is a bottom plan view of lower body member 56 of the pump cartridge of the instant invention.

As best seen in FIGS. 5B, 6A–6D, and 10 through 17, pump cartridge 50 is comprised of a middle body member 54 sandwiched between a lower body member 56 and an upper body member 58. A resilient D-ring member 220 and diaphragm 221 are sandwiched between middle body member 54 and upper body member 58 as best depicted in FIG. 13. D-ring member 220 is seated in D-ring seat 219. Diaphragm 221 seals the interior of body member 54 from an area defined by tapered aperture 59 in cartridge upper body member 58. Two inlet and two outlet check valves are provided in the form of one-way flapper-type valves 222, 224, 226, and 228, positioned in sealing engagement with valve seats 223, 225, 227, and 229, respectively, of middle body member 54 and lower body member 56. Descending from the underside of lower body member 56 are a pair of bladder receiving necks 240, 242 shown in FIG. 20, adapted to be placed into registry with the interior chambers of resilient bladder members 250, 252 as partially depicted in FIG. 5C. Bladders 250 and 252 are connected by resilient web 254 which is adapted to be placed into bladder web seat 260. Web 254 may be fused or otherwise sealingly connected to seat 260 by any known means. Preferably, bladders 250, 252 are manufactured of silicone rubber, but may, alternatively, be made of any material exhibiting elastic properties sufficient to allow for the deformation thereof when exposed to compression pressure from pneumatic circuit 90, yet to possess sufficient elastic memory to return to original form when not exposed to such pressurization. Cartridge 50 is manufactured of, preferably, rigid plastic. Members 54, 56, and 58 may be rigidly connected together upon assembly and held in such relationship by, for example, press-fitting, ultrasonic welding, adhesive, and/or the like.

Turning now to FIG. 13, each of check valves 222, 224, 226, and 228 are manufactured of a resilient elasticized (i.e. having memory) material which permits deflection thereof. Deflection of each valve is governed by the configuration of the valve seat 223, 225, 227, and 229, respectively, for each. As can best be seen in FIGS. 13 and 19, valves 222, 224, 226, and 228 are disc-shaped, having one side thereof generally planar and the other side thereof domed. Each may also be provided with a central bore a, b, c, d, respectively, to assist in locating same with respect to each valve seat. Corresponding posts e, f, g, h are associated with each of valve seats 223, 225, 227, and 229 on cartridge middle body member 54, respectively.

Figure 14A:
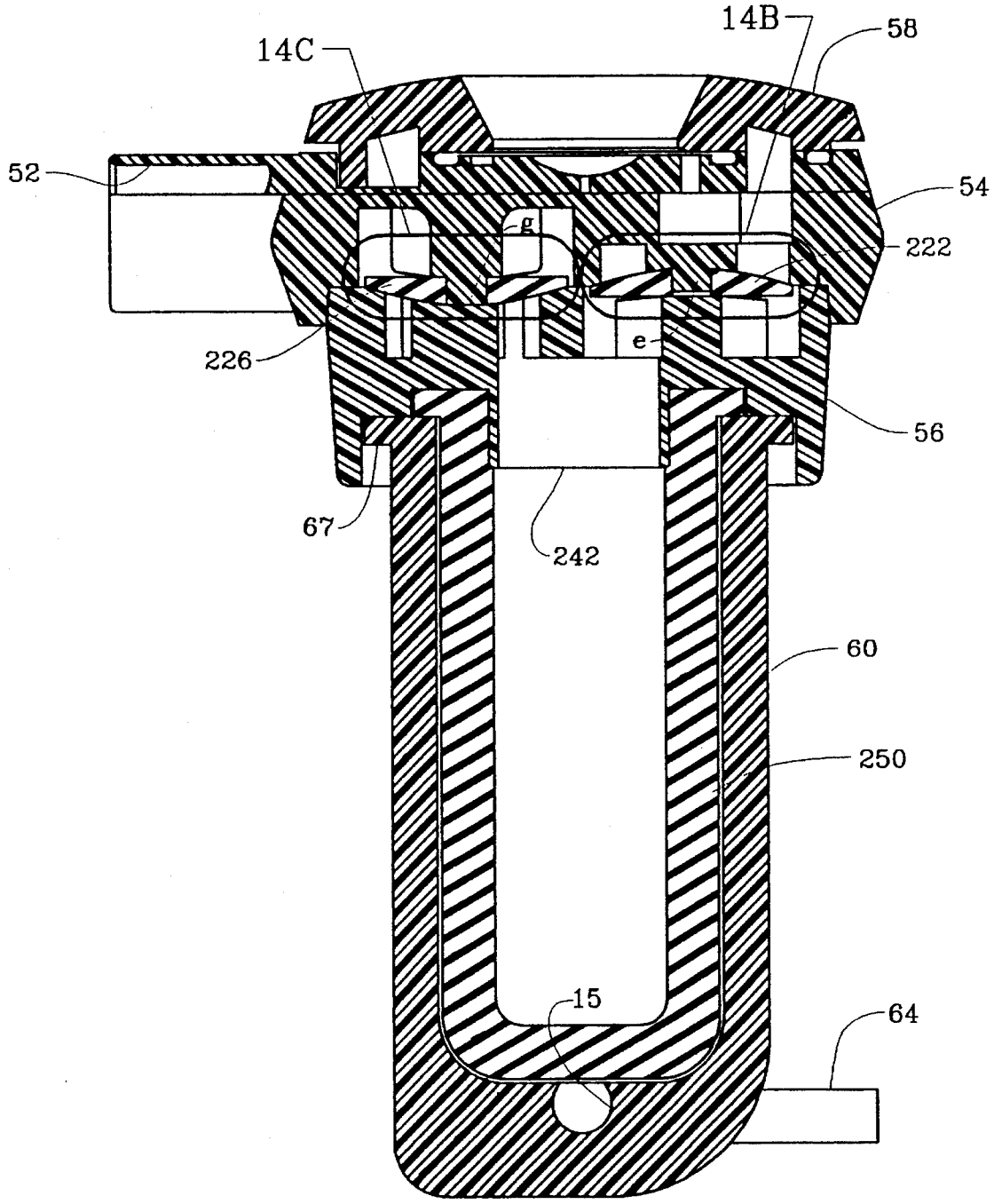
FIG. 14A is a cross sectional view taken along lines 14A—14A of FIG. 11.
Figure 14B:
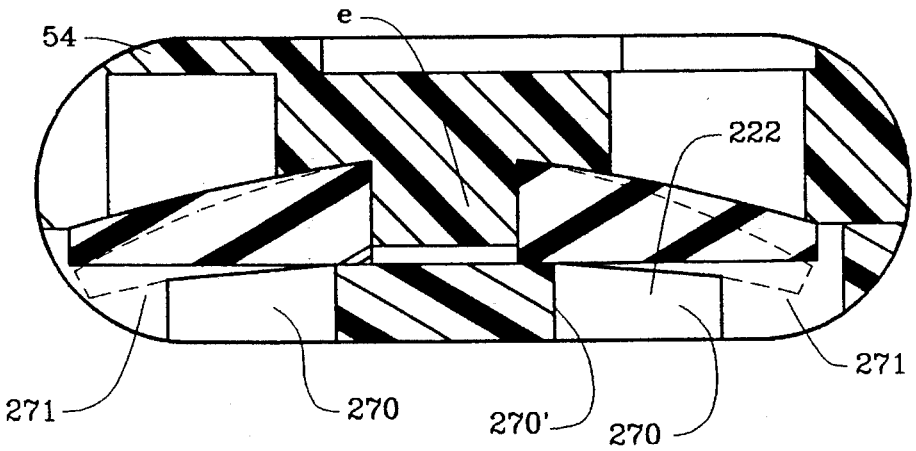
FIG. 14B is an enlarged view of the area indicated as "14B" in FIG. 14A.

Check valves 222, 224 act as one-way inlet valves, permitting working fluid flows $I_1$, $I_2$, which enter cartridge common inlet chamber 230 of cartridge body member 54 through inlet passageways 55, 57, to enter bladders 250, 252 through inlet ports 271, 273, while preventing reverse flow therethrough of working fluid. To effectuate this, in the preferred embodiment, vanes 270 are disposed radially across a portion of inlet ports 271, 273 of middle cartridge body member 54 on the downstream side of check valves 222, 224. The check valve-facing surface of vanes 270 are dome-shaped corresponding to the dome shape of check valves 222, 224. In addition, vanes 270 extend radially from post members 270' of lower body member 56 on the downstream side of check valves 222, 224, and have a generally tapered upper surface profile to allow the peripheral outer edges of check valves 222, 224 to deflect as shown in FIG. 14B and thus allow working fluid to be forced from inlet chamber 230 into bladders 250, 252 via inlet ports 271, 273 and necks 240, 242, respectively as shown in FIGS. 13, 14A, and 14B. Valve risers 223', 225' define bladder inlet ports 271, 273, which communicate cartridge inlet chamber 230 with bladders 250, 252 via bladder retaining necks 240, 242.

Figure 14C:
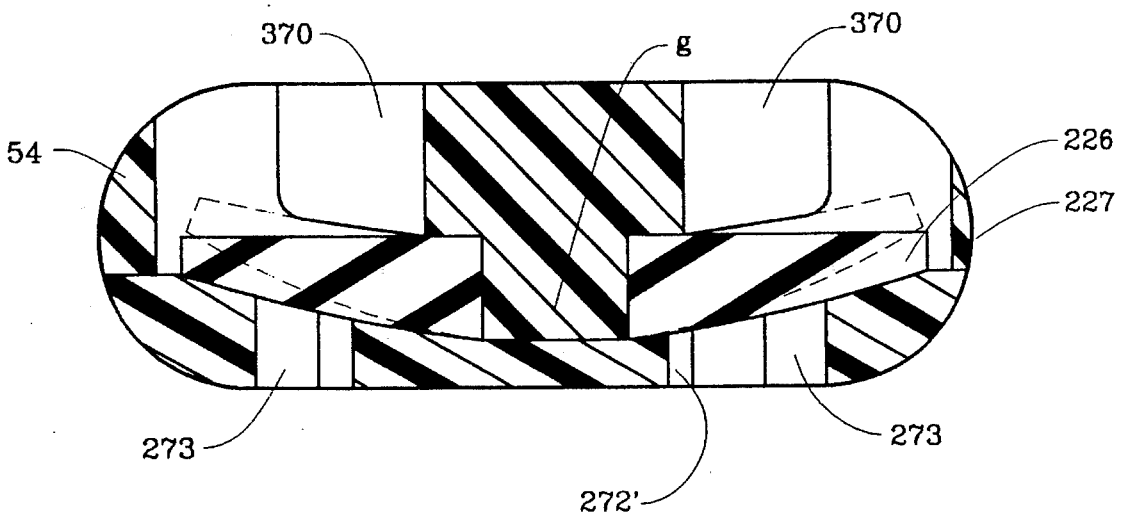
FIG. 14C is an enlarged view of the area indicated as "14C" in FIG. 14A.
Figure 15:
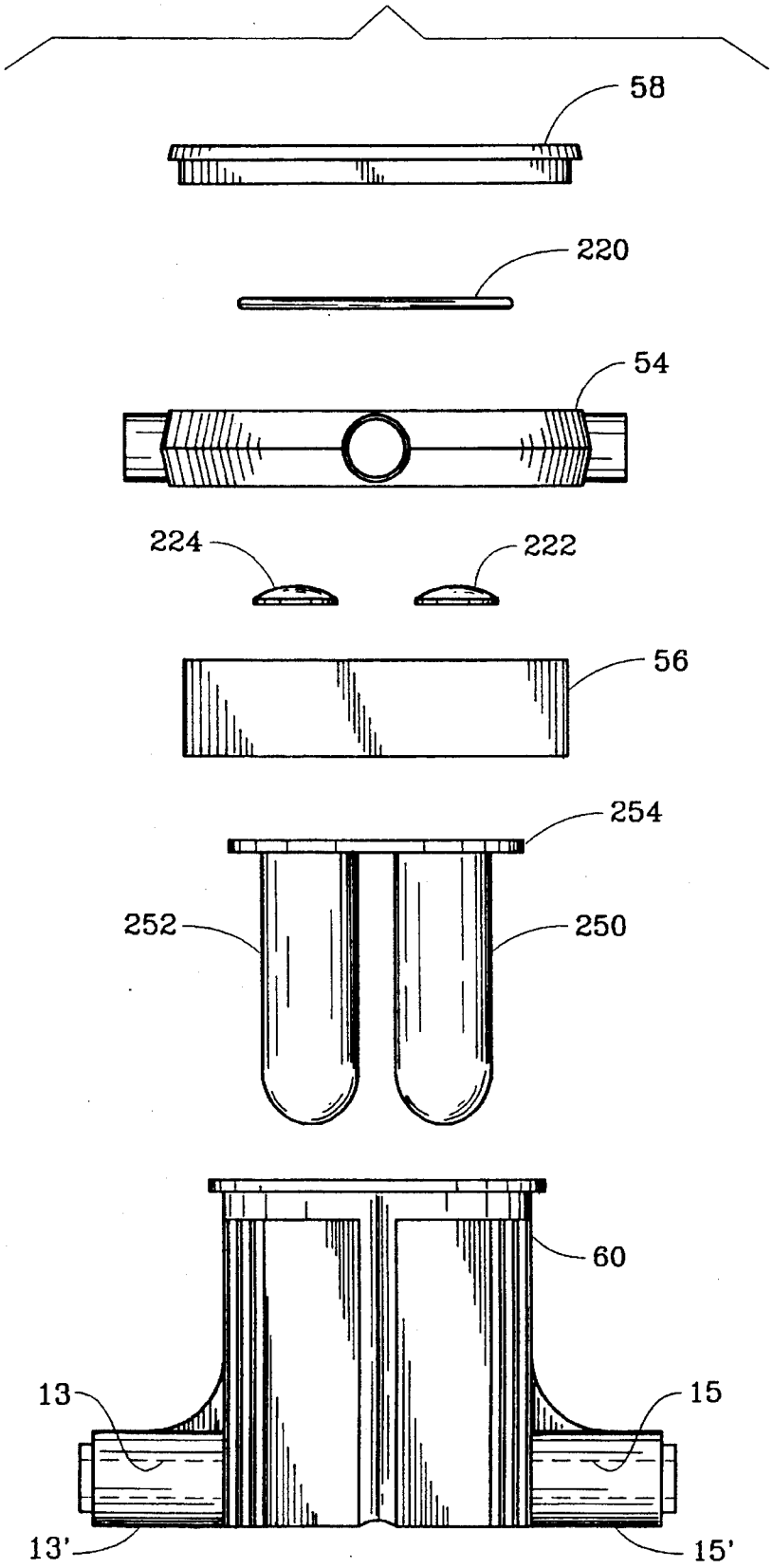
FIG. 15 is a front elevational exploded view of the cartridge and bladders/bladder housing arrangement of the invention.
Figure 16:
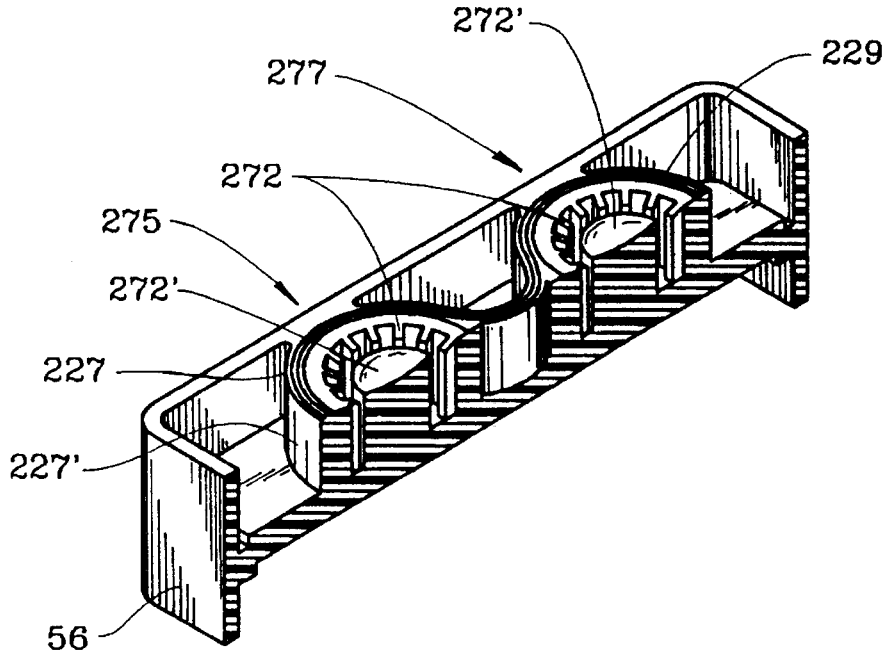
FIG. 16 is a cross section of the pump cartridge of the instant invention taken along lines 16—16 of FIG. 13.
Figure 17:
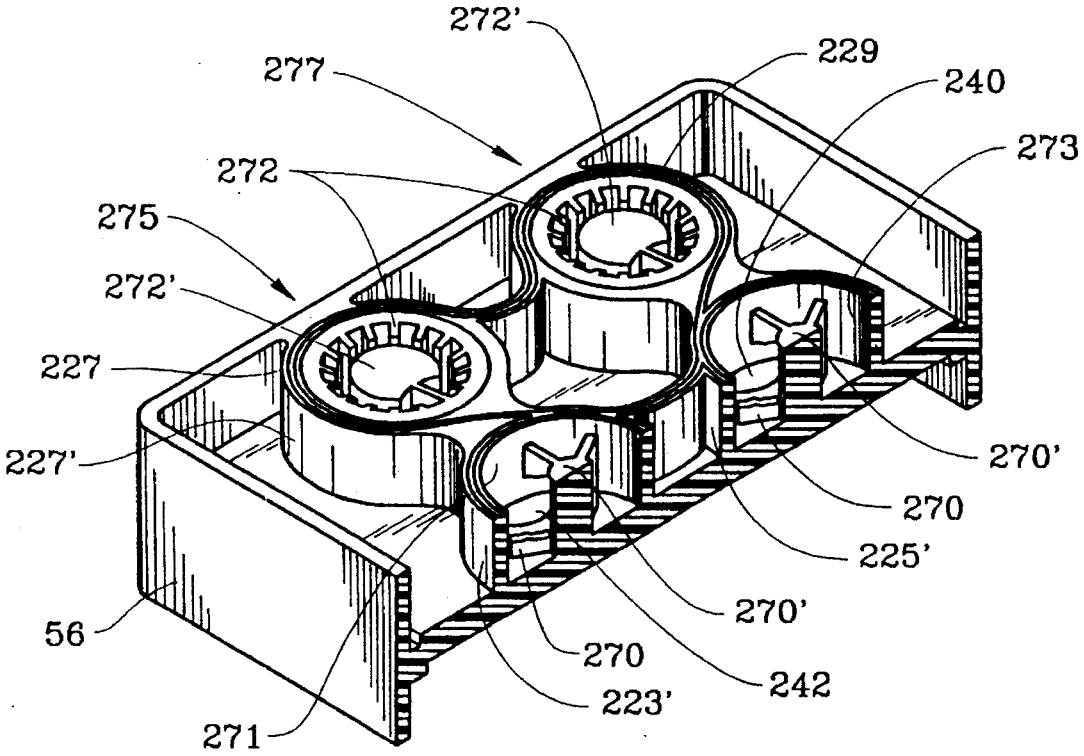
FIG. 17 is a cross section of the pump cartridge of the instant invention taken along lines 17—17 of FIG. 13.
Figure 18:
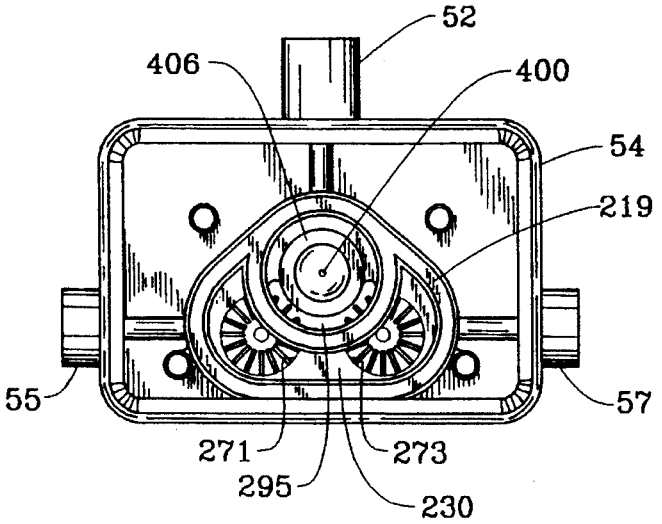
FIG. 18 is a top plan view of middle body member 54 of the pump cartridge of the instant invention.

Turning again to FIGS. 13, 18, 19, and 20, cartridge middle body member 54 defines a common outlet chamber 290 therein adjacent discharge passageway 52 which is fluidly communicated with the interiors of bladders 250, 252 via outlet ports 275, 277 and necks 240, 242. Check valves 226, 228 are disposed across outlet ports 275, 277 to permit outflow of working fluid from the bladders into discharge chamber 290, while preventing reverse flow of working fluid therethrough. Radial vanes 272 are disposed radially across outlet ports 275, 277, of lower cartridge body member 56 having a disked or arcuate upper surface profile corresponding to the shape of the domed lower surfaces of check valves 226, 228. Vanes 272 extend radially inwardly from seats 229 and 227 and outwardly from posts 272' across outlet ports 275, 277 on the upstream side of check valves 226, 228 to support check valves 226, 228 under pressure The check valve-facing surfaces thereof are curved to correspond to the lower surface profile of check valves 226, 228. Tapered vanes 272 are connected to cartridge middle body member 54 and allow the outer peripheral edges of valves 226, 228 to deflect as shown in FIG. 14C so as to permit working fluid to be forced from bladders 250, 252, through necks 240, 242, outlet ports 275, 277 and into outlet chamber 290, whereupon said working fluid is ejected from the pump cartridge through discharge port 52.

Cartridge inlet chamber 230 is sealed at its upper periphery by D-ring 220. Integrally connected to D-ring 220 is a resilient diaphragm 221, which may be circular when viewed from above and which makes up a portion of a means for venting the cartridge discharge chamber 290 to the cartridge inlet chamber 230, i.e. to the upstream side of inlet check valves 222, 224. This has the effect of fluidly communicating the pressurized working fluid on the downstream side of outlet check valves 226, 228 with the source of working fluid, which is inherently at a lower pressure than the pressurized working fluid. Such venting occurs in the mode and manner to be described in more detail below.

Figure 6A:
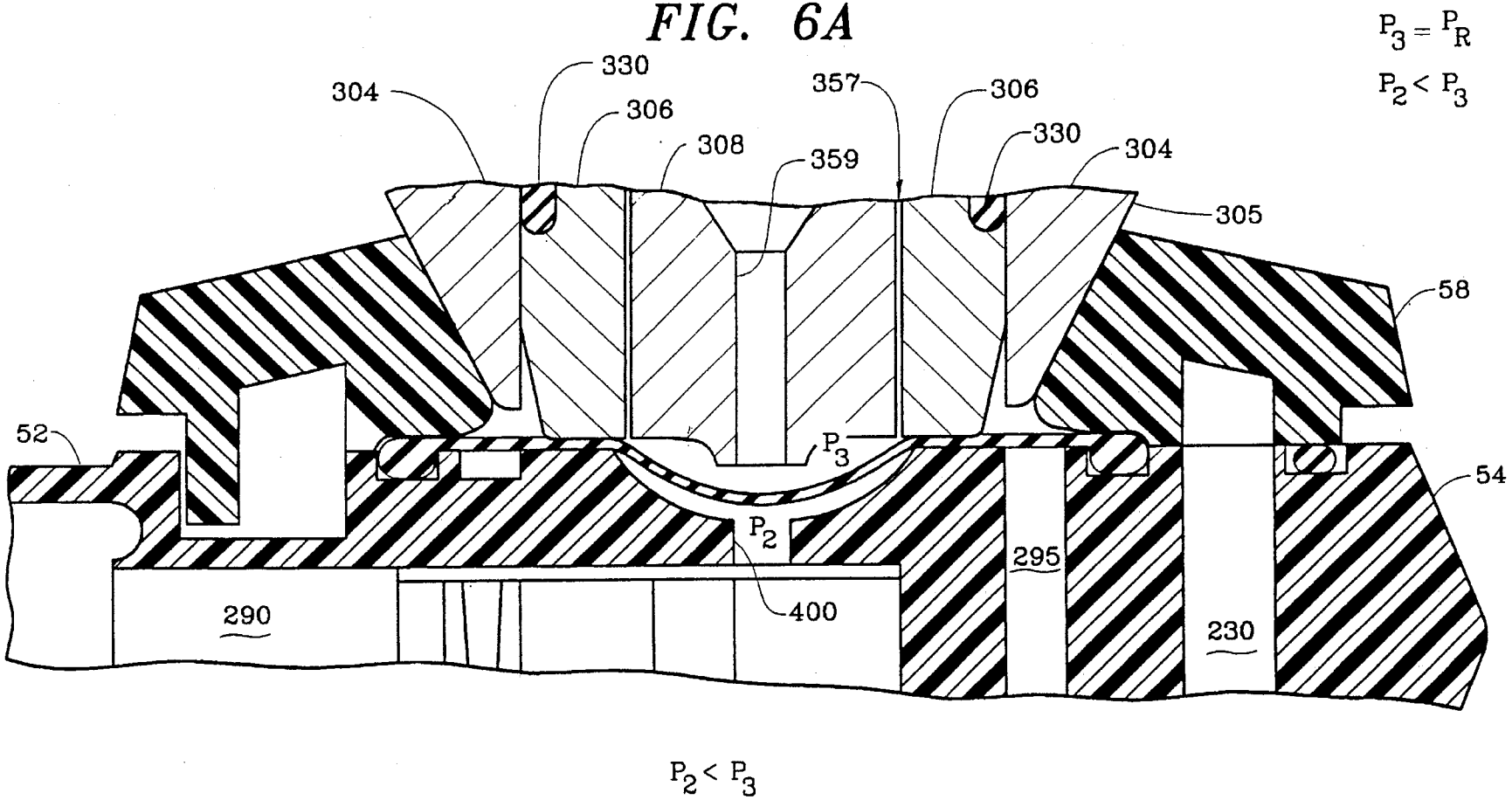
FIG. 6A is an enlarged view of the area indicated as "6A" in FIG. 5B, where the pressure of the discharging working fluid equals the system reference pressure, as when working fluid is being ejected through the point of use instrument.
Figure 6B:
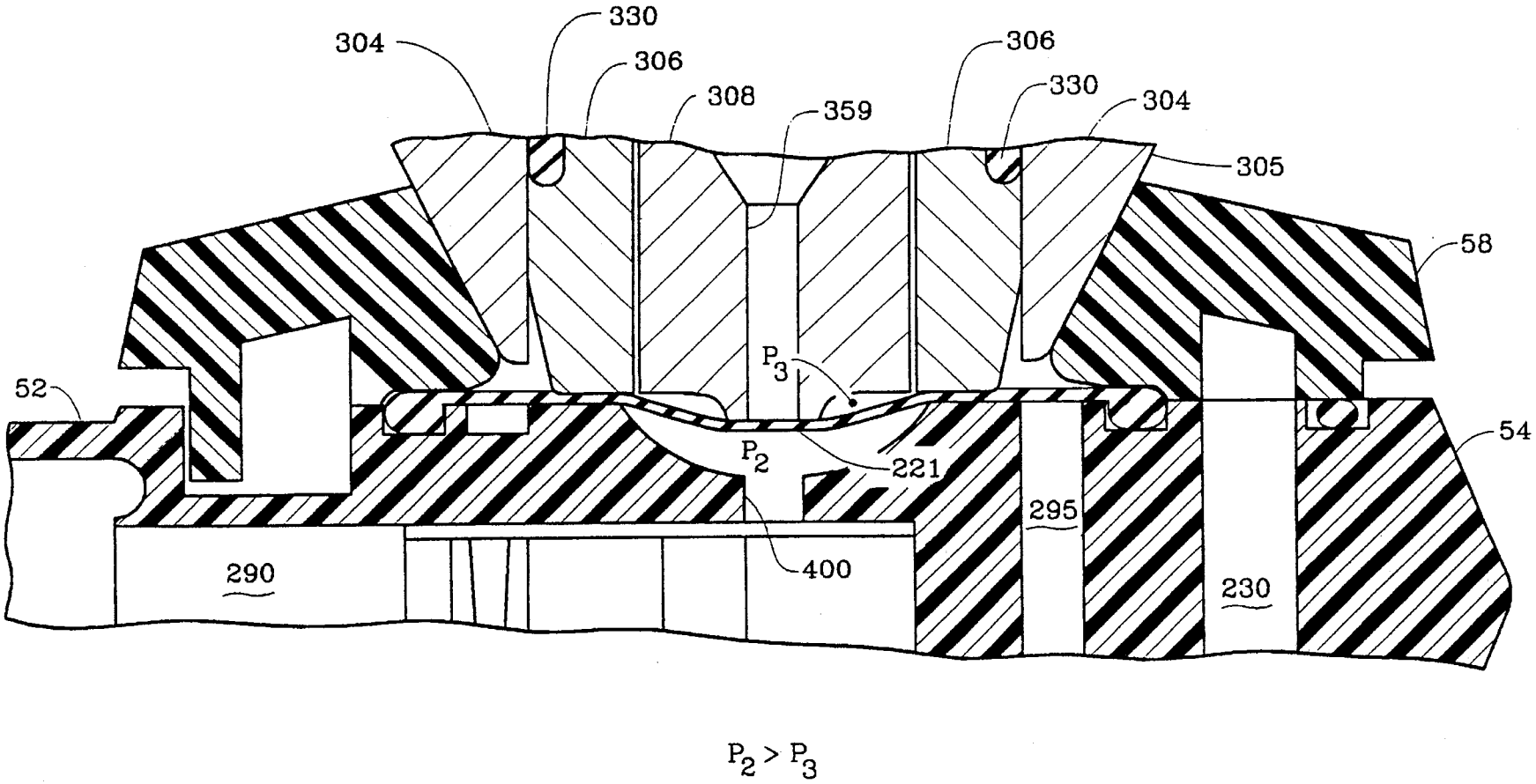
FIG. 6B is an enlarged view of the area shown in FIG. 6A but where the working fluid pressure is greater than the system reference pressure, as when the pump is turned on but the point of use instrument closed off.
Figure 6C:
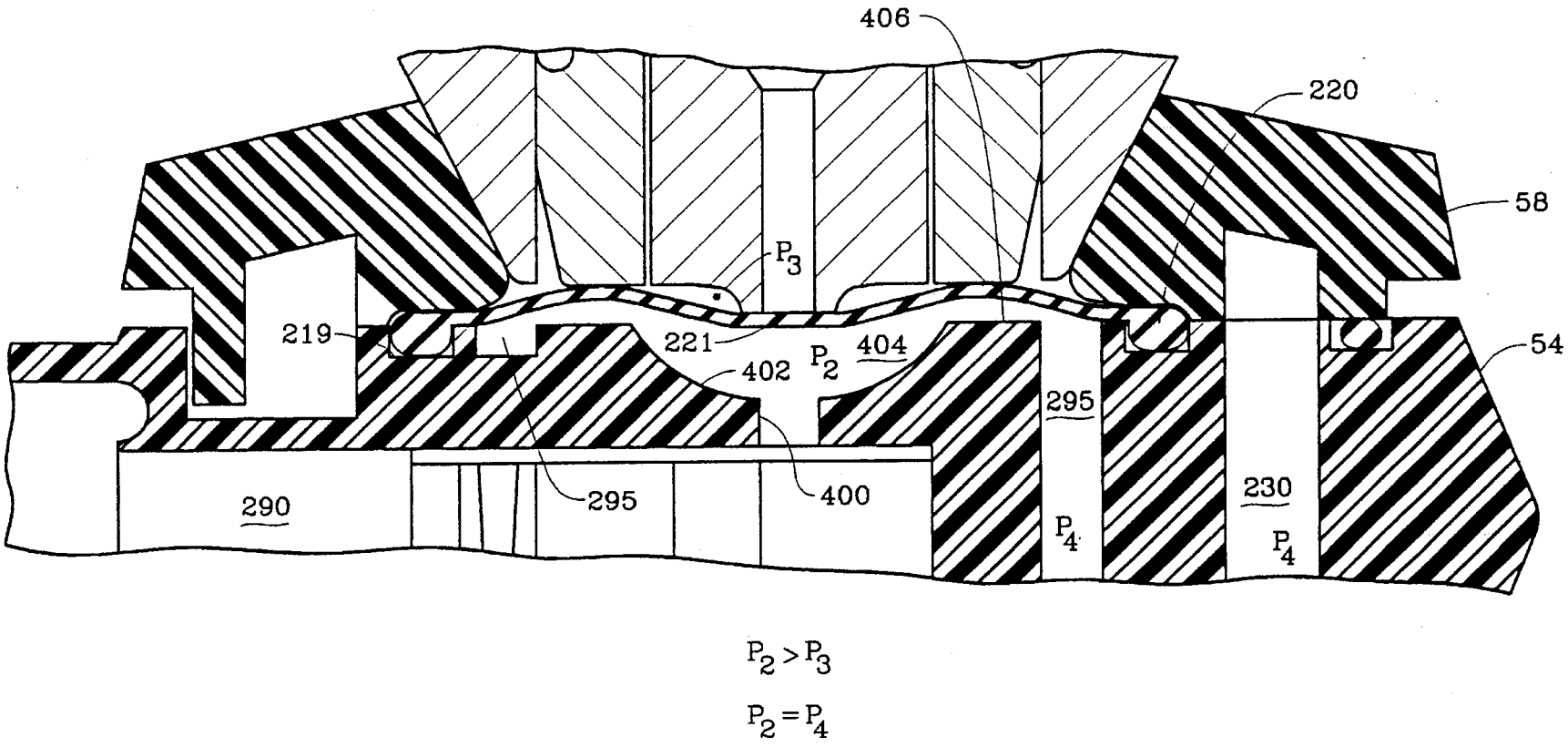
FIG. 6C is an enlarged view of the area shown in FIG. 6A but where the cartridge discharge chamber is vented back to the working fluid supply, corresponding to the condition where the pump has just been de-energized.
Figure 6D:
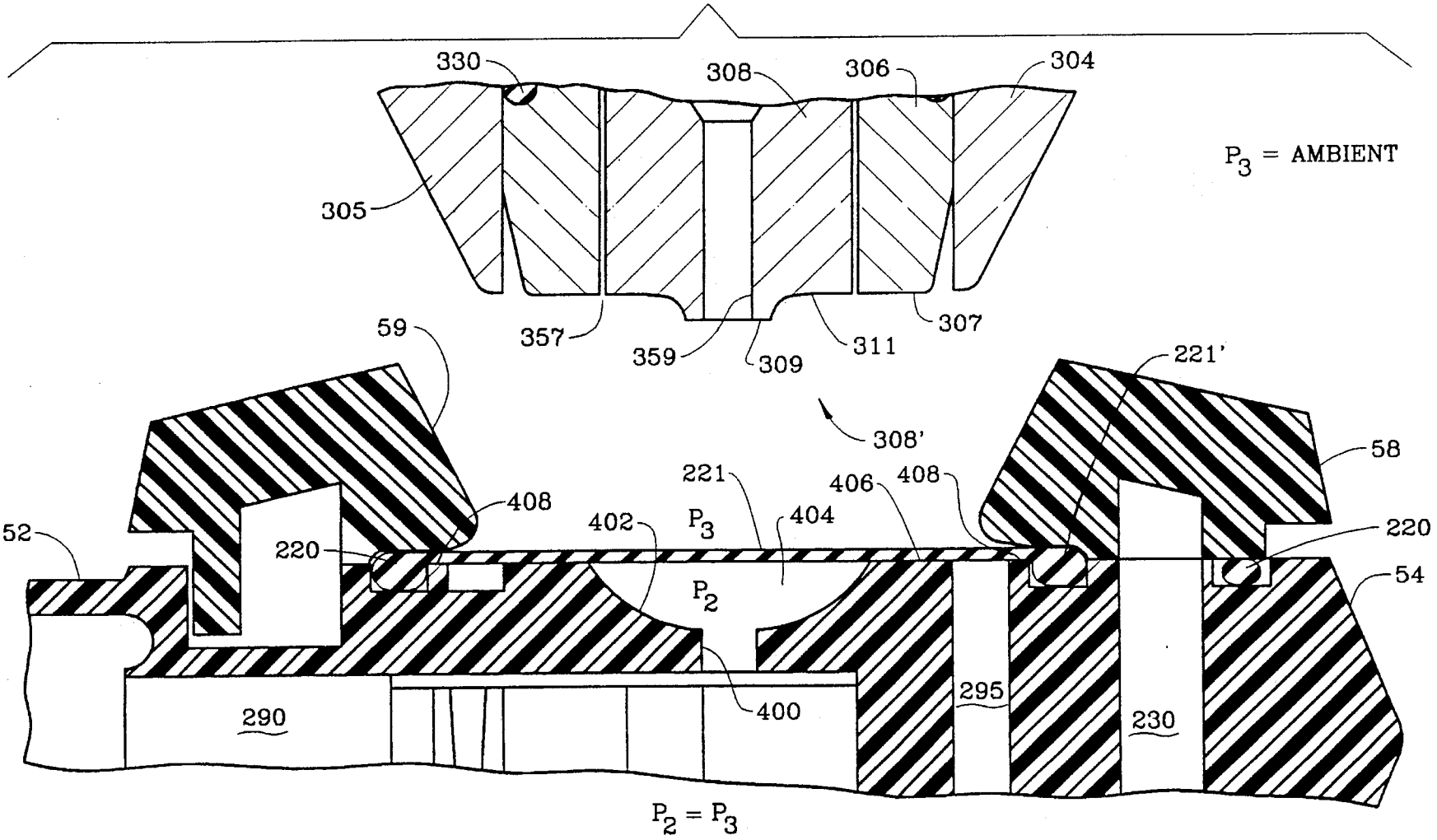
FIG. 6D is an enlarged view of the area shown in FIG. 6A but where the locking means has come to rest in the fully unlocked state after the pump has been switched off and the working fluid pressure has been vented back to the working fluid supply reservoirs.

As best seen in FIGS. 6A–6D, 13, 18, and 19, the means for venting is comprised of a vent chamber 295 fluidly communicated with common inlet chamber 230 by virtue of it being disposed in partial overlying relationship with inlet ports 271, 273. The means for venting is further comprised of a bowl-shaped antechamber 404 which is fluidly communicated with cartridge outlet chamber 290 via bleed orifice 400. Antechamber 404 is defined by semi-spherical surface 402 of cartridge middle body member 54. Vent chamber 295 is normally sealed from antechamber 404 by diaphragm 221 disposed in sealing engagement with diaphragm mating surface 406 of body member 54, as best seen in FIGS. 6A, 6B, and 6D. Under appropriate conditions, such as illustrated in FIG. 6C, diaphragm 221 is displaced by an elevated pressure state in the working fluid within antechamber 404 such that antechamber 404 is fluidly communicated with vent chamber 295, which in turn vents working fluid from common outlet chamber 290 to common inlet chamber 230.

Figure 7:
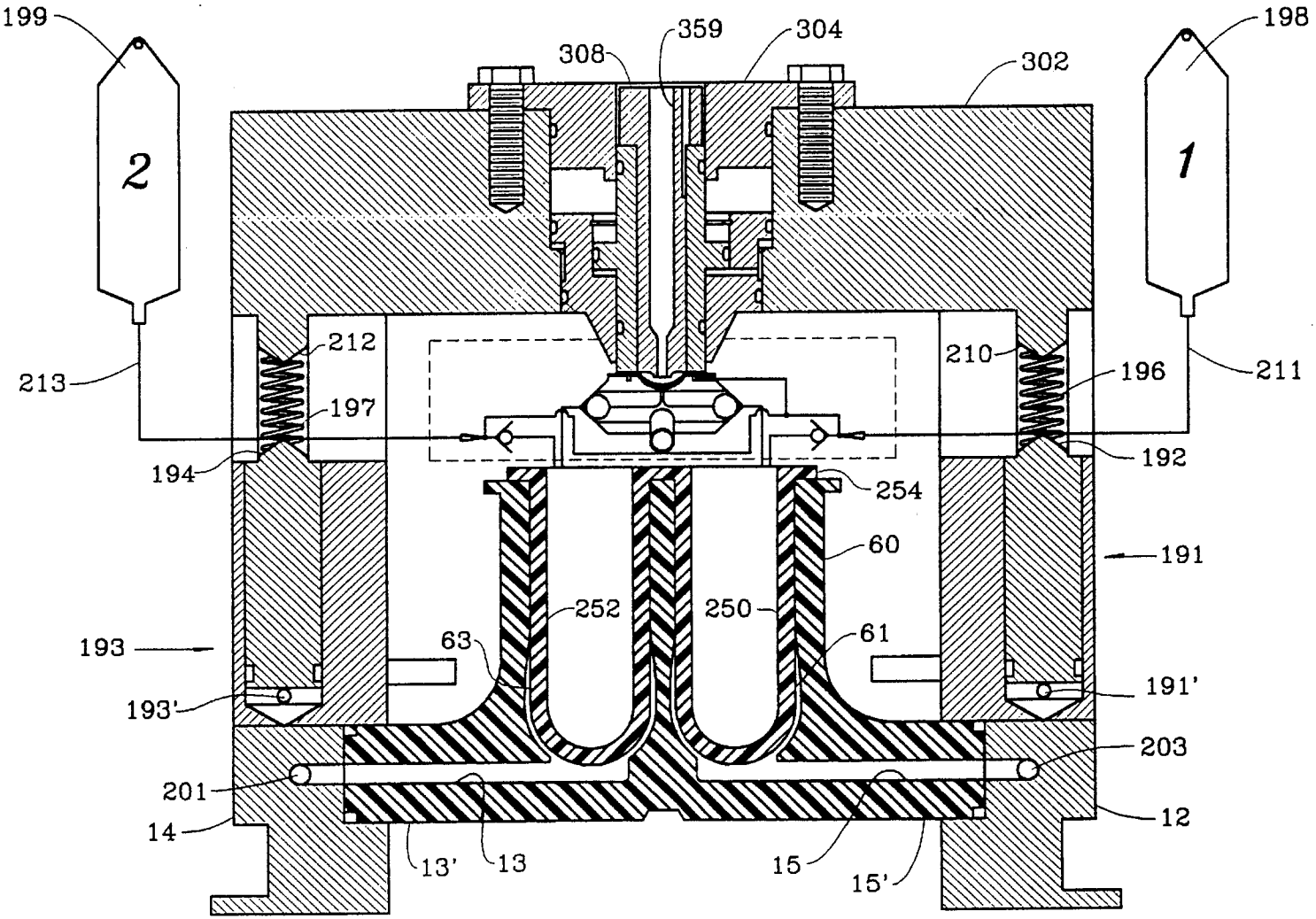
FIG. 7 is a cross sectional partial schematic illustration showing the relationship of the working fluid supply, cartridge, locking means, and bladder/bladder housing arrangements.
Figure 22:
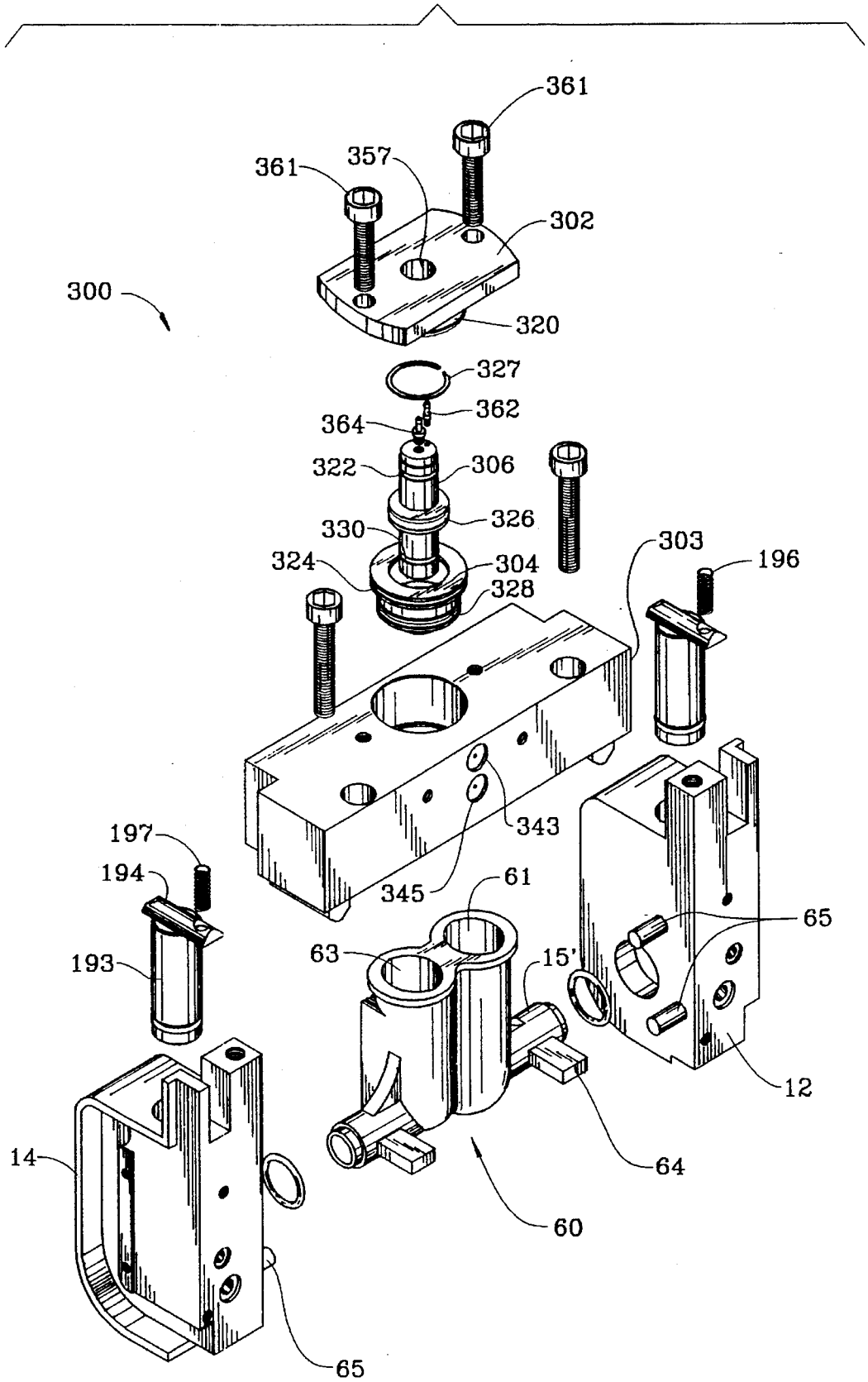
FIG. 22 is a perspective, exploded view of the locking mechanism for the pump chambers.

Another unique feature of the invention is shown in FIGS. 5A through 6D in the form of a cartridge and bladder quick-release feature. Bladder housing body member 60, as shown in FIGS. 7 and 22, is pivotally connected to trunions 12 and 14 at bladder housing struts 15', 13', which define operating fluid passageways 15, 13. Passageways 15, 13 fluidly communicate oscillating subcircuit 92 of pneumatic circuit 90 with compression chambers 61', 63', respectively. Said compression chambers are defined by the interior walls of bladder housing body member 60. To avoid the potential of exposing one patient to the bodily fluids of another patient, it is desirable to replace cartridge 50 and bladders 250, 252 in their entirety prior to using the pump P with a new patient. For this reason, bladder housing 60 is pivotable from a first, in-use, position shown in FIGS. 5A and 5B to a second, tilted, position shown in FIGS. 5D and 5E. In the tilted position, cartridge 50 and bladders 250, 252 are simply lifted out of position with respect to bladder housing 60 and a new cartridge/bladder element installed, as represented in FIG. 5E. Limit posts 65 may be employed to act as a stop against rotation of bladder housing 60 beyond a predetermined angle, defined by the position of stop bars 64, 66 connected to bladder housing 60.

Figure 4A:
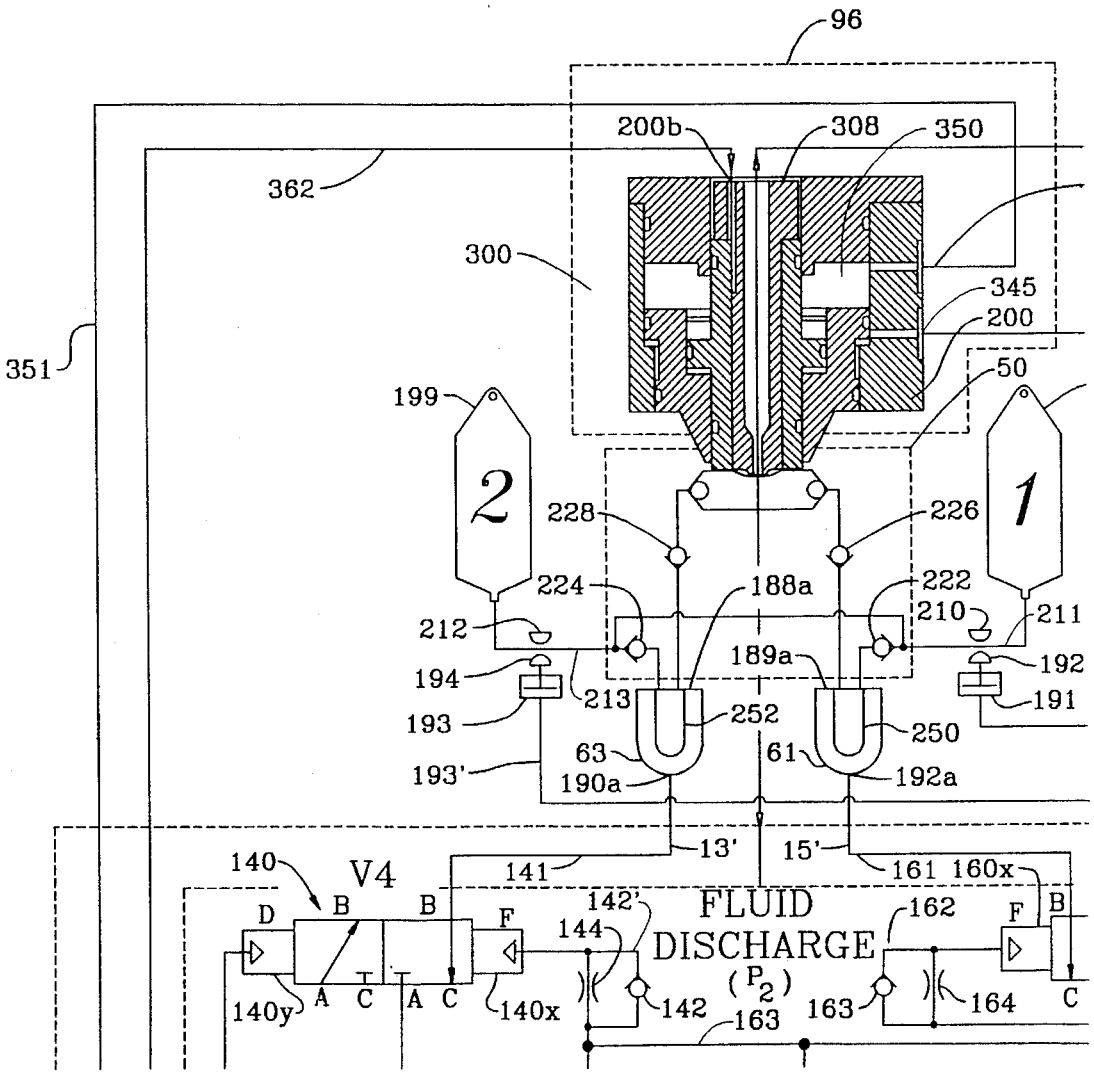
FIGS. 4A–4F illustrate schematically the overall system of the invention including a pneumatic circuit and locking means which may be used to operate the pump.
Figure 4B:
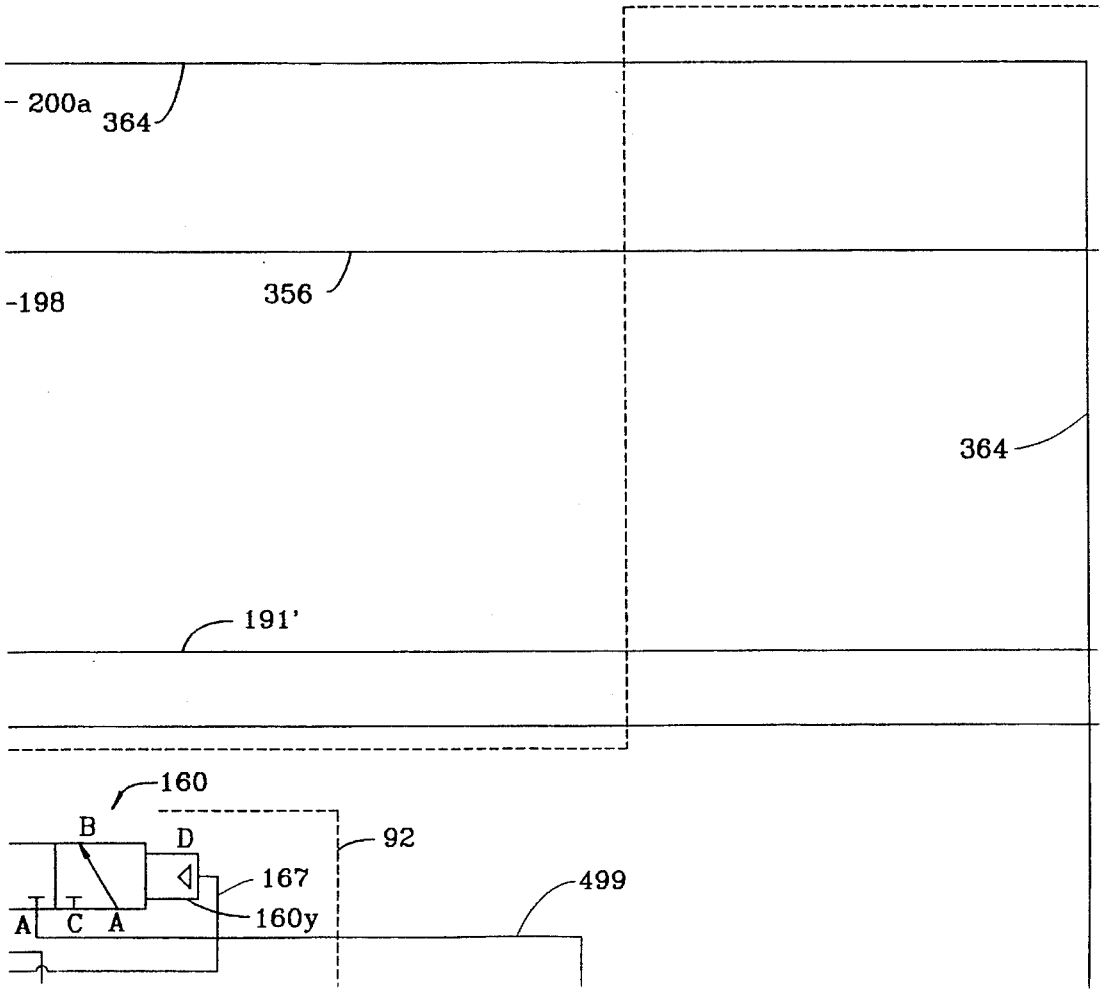
Figure 4C:
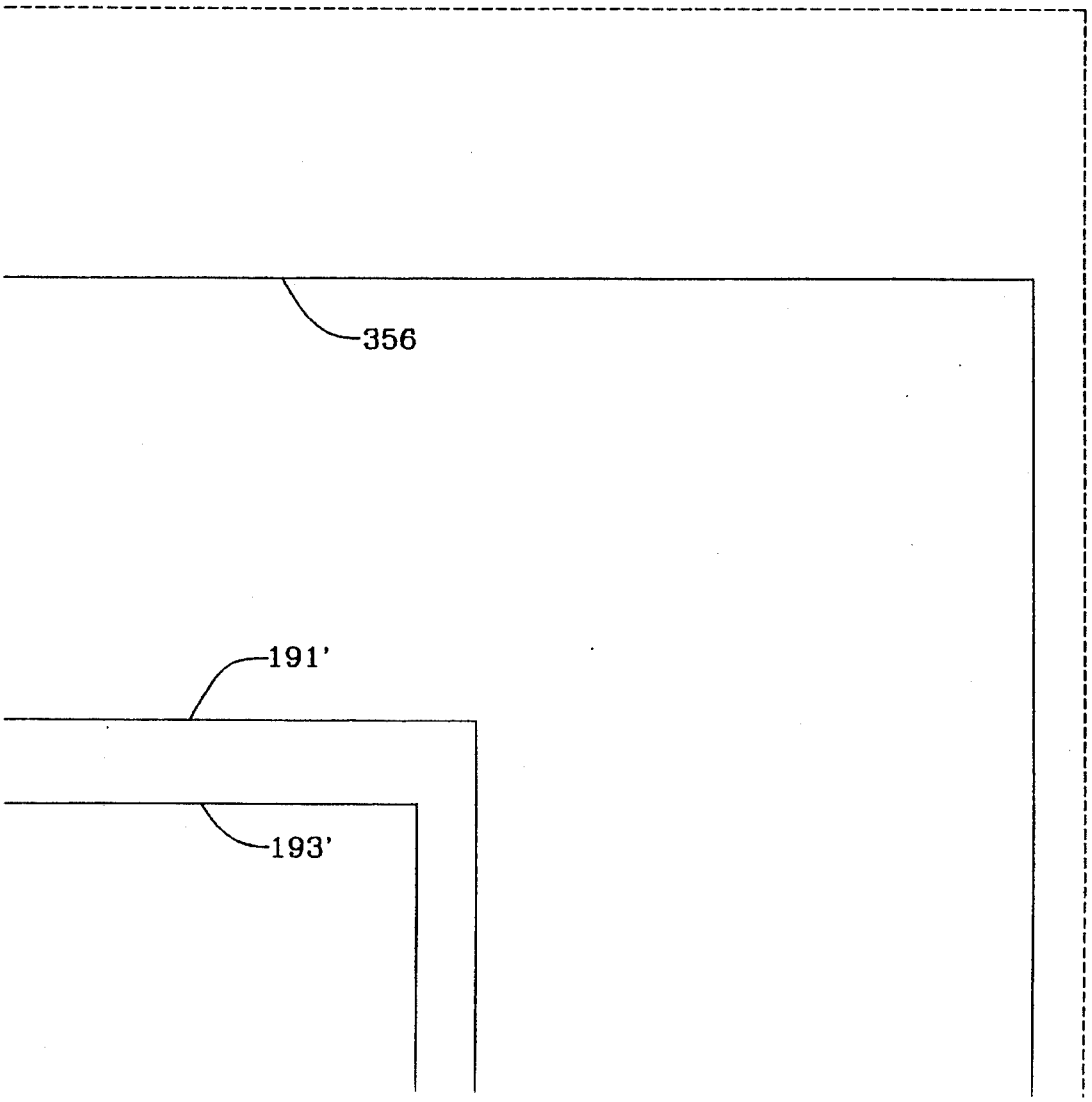
Figure 4D:
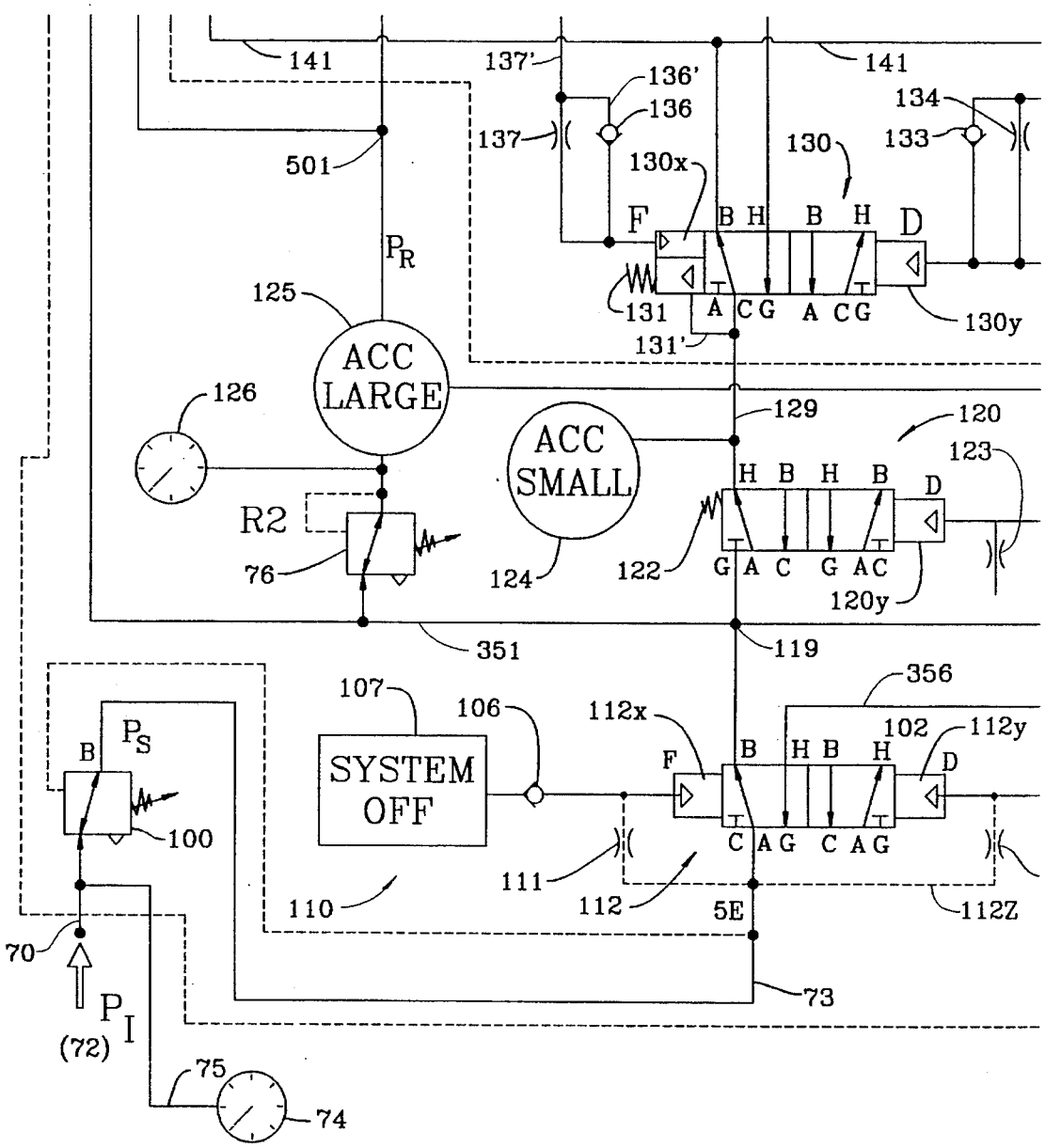
Figure 4E:
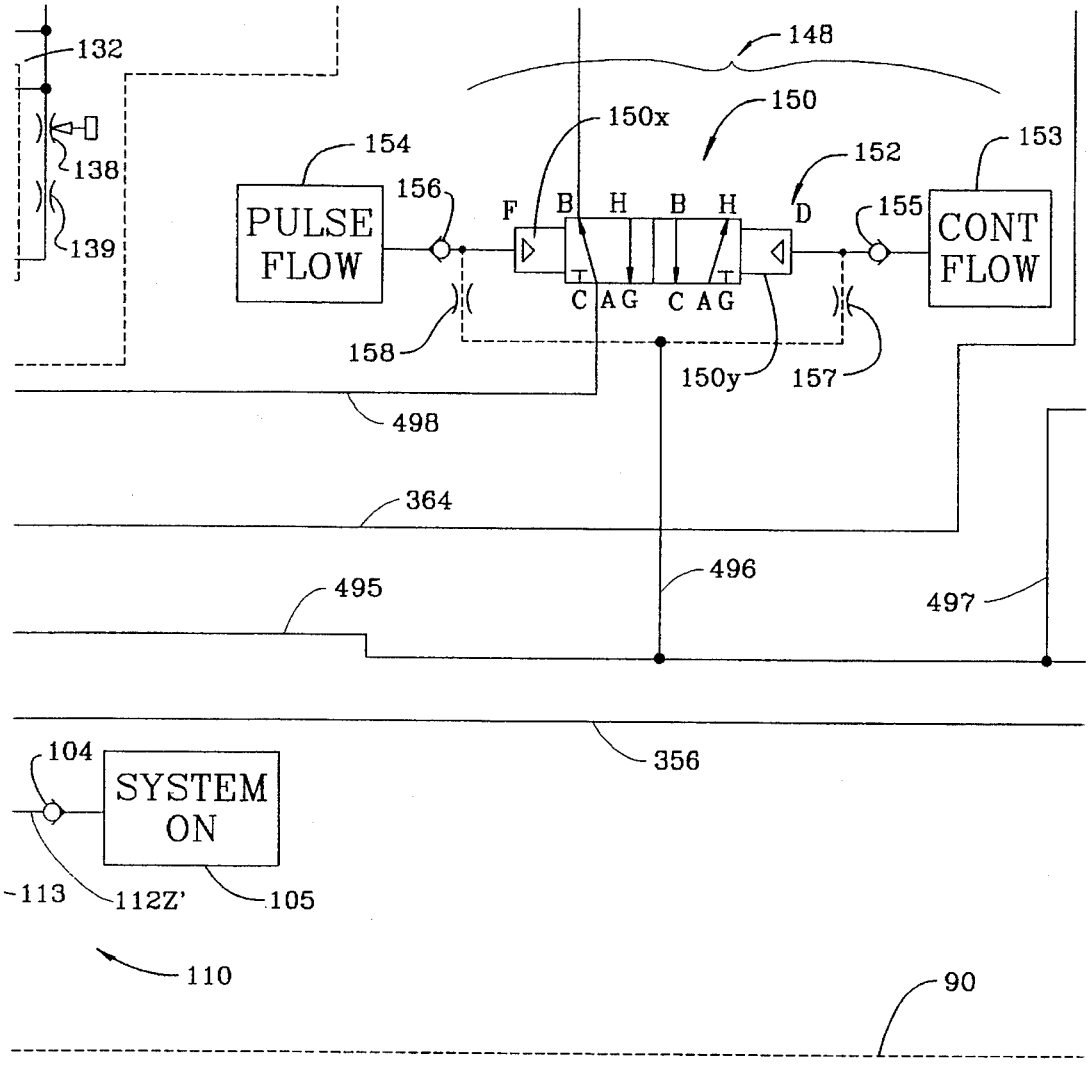
Figure 4F:
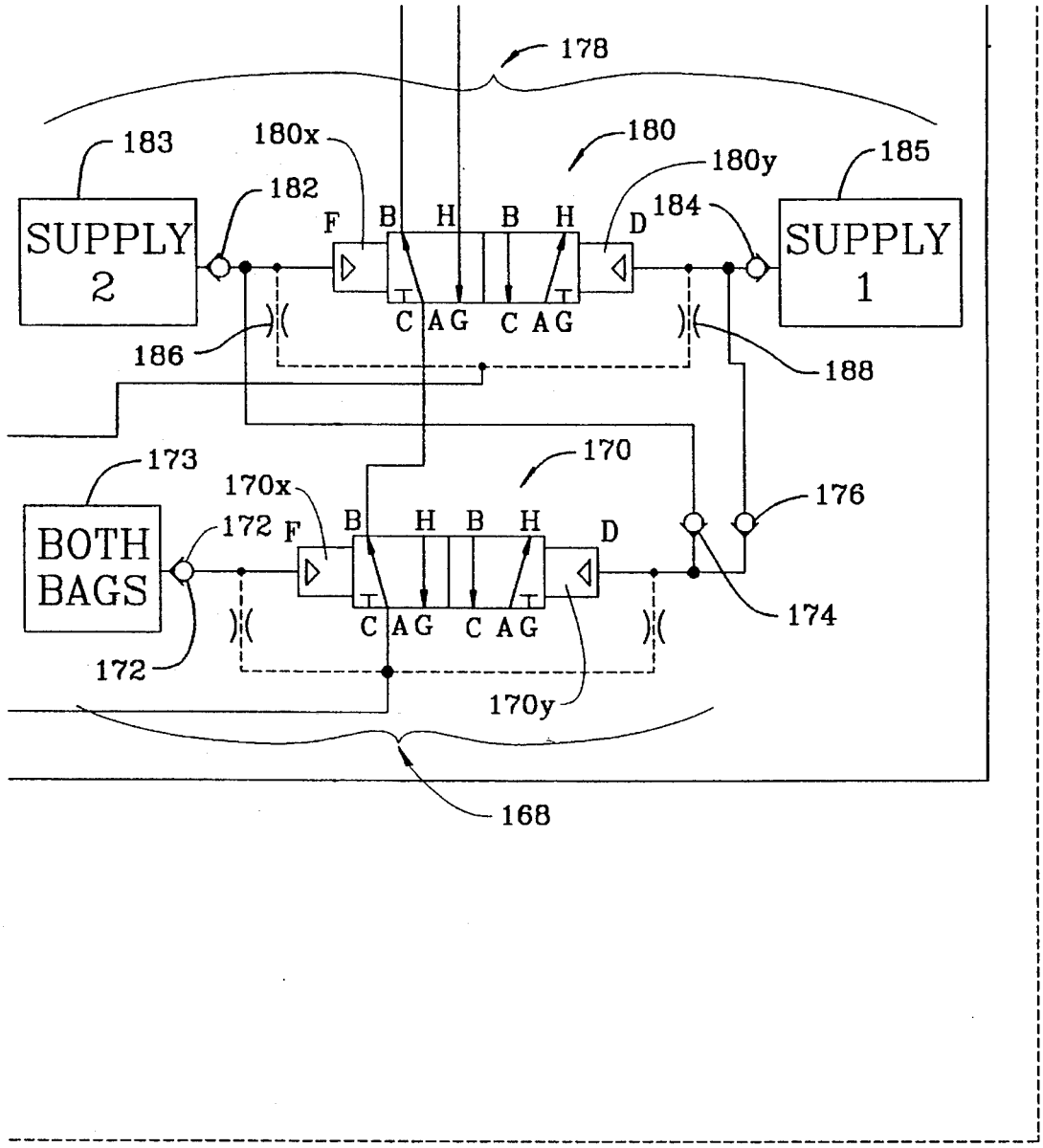
Figure 5A:
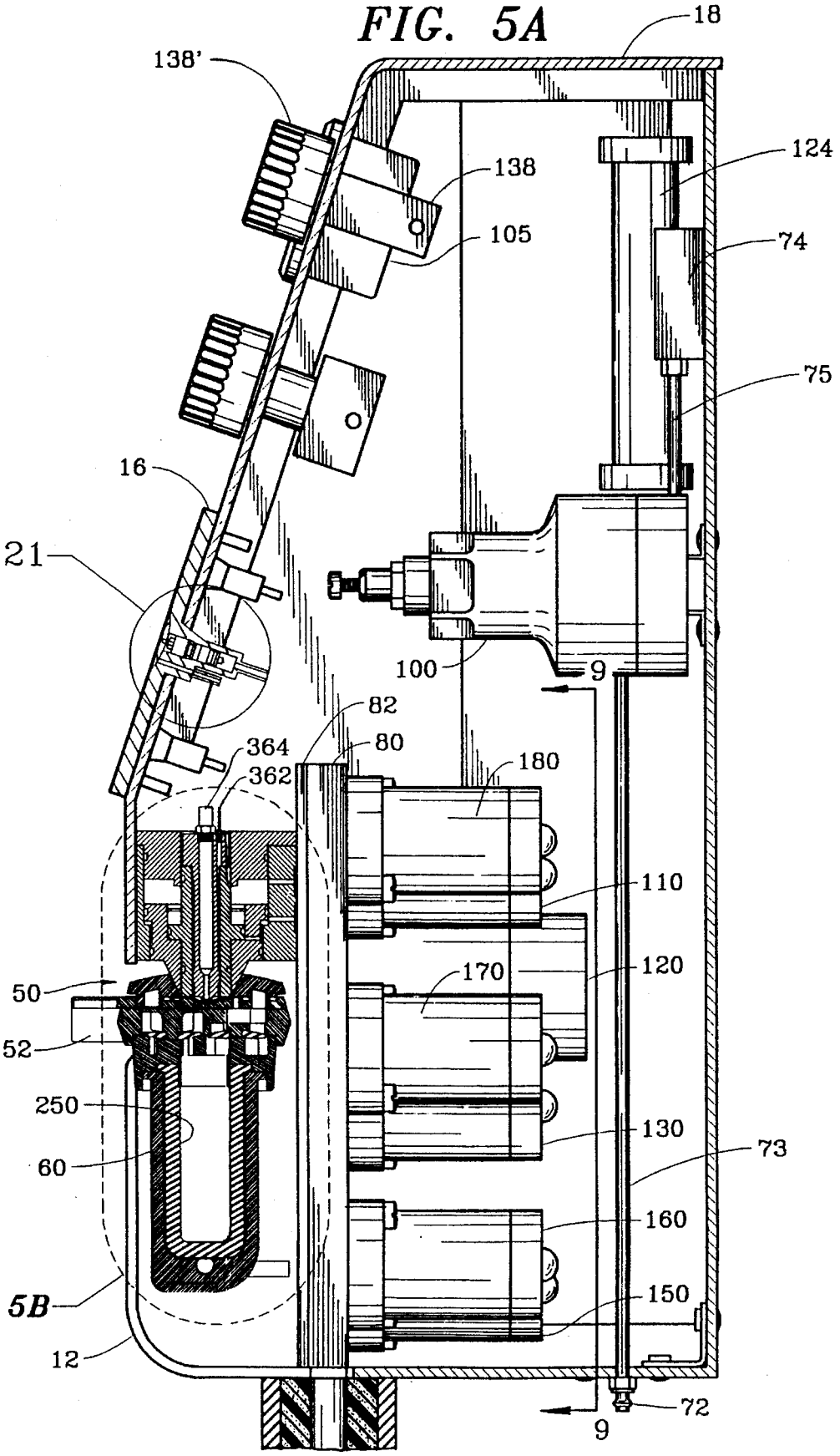
FIG. 5A is a cross sectional view taken along lines 5A—5A of FIG. 3B.
Figure 5B:
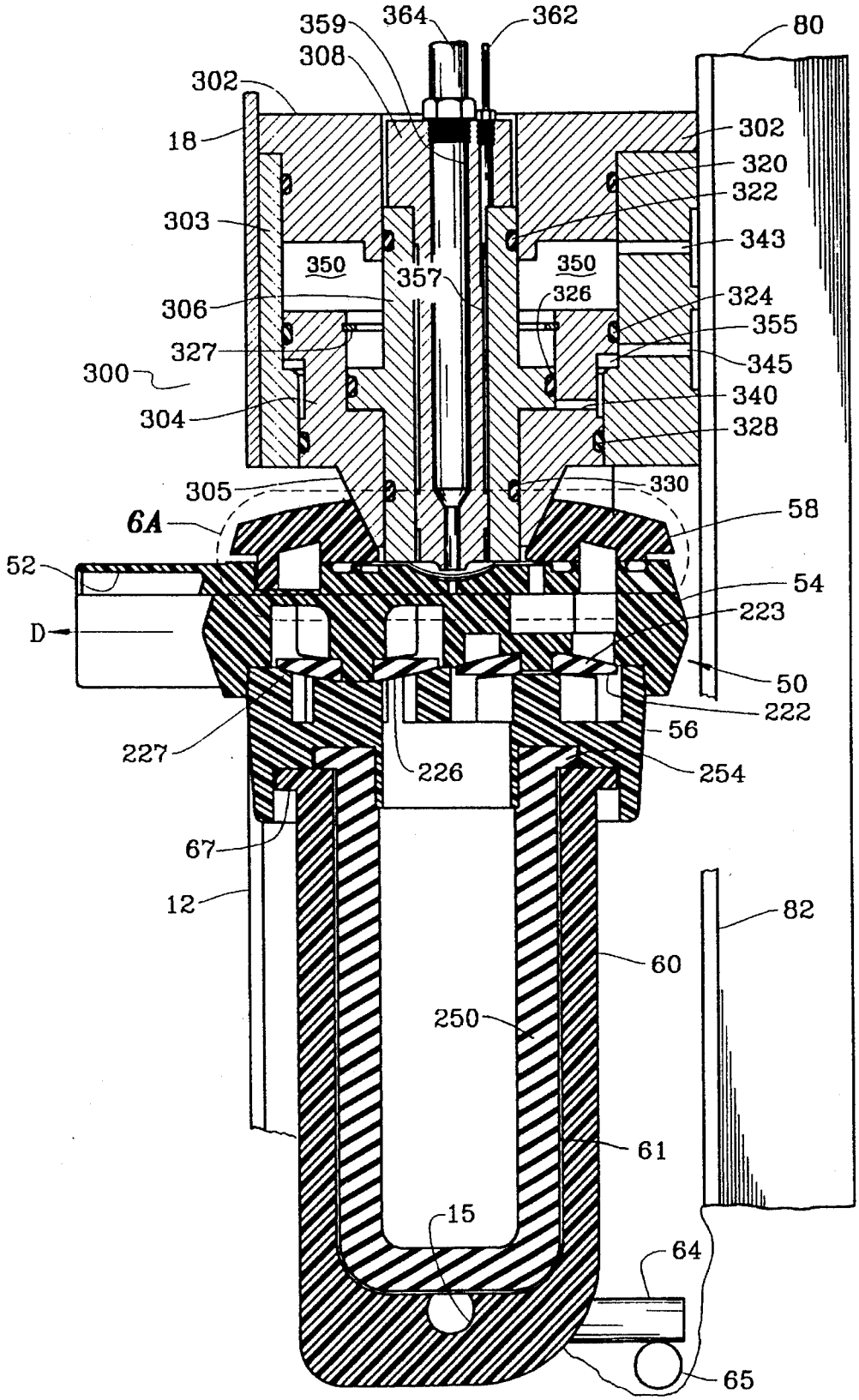
FIG. 5B is a closeup of the area of detail shown in FIG. 5A, where the locking means is in the lowered position.

The locking means of the instant invention is shown in detail in FIGS. 5B, 5C, and 6A through 6D and 22, and is comprised generally of three pistons, an outer piston 304, a middle piston 306, and an inner or sensor piston 308, all movable as a unit between a first, locked, position shown in FIG. 5B and a second, unlocked, position shown in FIG. 6D. Middle and inner pistons 306, 308 may, in an alternative embodiment, be manufactured as a single element, but for ease of manufacture, are shown as two elements integrally connected in the preferred embodiment. Outer piston 304 is movable with respect middle piston 306. Pistons 304, 306, 308 are reciprocally movable with respect to housing 18 by being placed in sliding engagement within cylinder 303, which is sealed against outer piston 304 by O-rings 324, and 328. Middle piston 306 is sealed against outer piston 304 by O-rings 326 and 330. Middle piston 306 is also sealed against cylinder cap 302 by O-ring 322, and cylinder cap 302 is sealed against cylinder 303 using O-ring 320. Center piston 308 defines a central bore 359 therethrough which is adapted to communicate the volume ($P_3$) above diaphragm 221 with pilot valve 120 via conduit 364, best shown in FIGS. 4A through 4F. A generally annular channel 357 surrounds inner piston 308 and is adapted to communicate the aforementioned volume above diaphragm 221 with reference pressure from large accumulator 125 via conduit 362. A piston lowering cavity 350 is defined by outer piston 304, piston cylinder 303, 302, and middle piston 306, and is fluidly communicated with pilot valve 110 via conduit 351 and piston lowering cylinder port 343. A piston raising cavity 355 is defined by outer piston 304, middle piston 306, and cylinder 303, and is fluidly communicated with pilot valve 110 via conduit 356 and piston raising cylinder port 345.

As best shown in FIG. 6D, outer piston 304 defines a tapered, conical, nose section 305 adapted to mate in interfitting engagement with conically tapered opening 59 of pump cartridge upper body member 58. Center piston 306 defines a lower diaphragm-mating surface 307 corresponding to the ring-shaped diaphragm mating surface 406 defined by cartridge middle body member 54. Finally, inner piston 308 defines a nose or head end 308' comprised of a recessed surface 311 and a protruding diaphragm engagement surface 309 surrounding inner piston bore 359.

Referring now to FIGS. 6A, 6B, and 6C, a locking piston arrangement is formed by the lower ends of outer piston 304, middle piston 306, and inner piston 308, such that the cartridge 50 and bladder housing body member 60 are held in their locked position against rotation about trunions 12 and 14. This condition is brought about when the system "on" switch 105 in FIG. 4E is depressed, thereby placing pilot valve 110 in the position shown in FIG. 4D, wherein system pressure $P_S$, which is the output of regulator 100, is supplied to piston lowering volume 350 in FIG. 4A. When working fluid is being discharged through point-of-use instrument I, the pressure within the working fluid downstream of the outlet check valves 226, 228 is less than the reference pressure $P_3$ of the system, which state is shown in FIG. 6A. When flow through the point-of-use instrument I is terminated, the pressure of the working fluid $P_2$ increases such that it exceeds reference pressure $P_3$, which forces diaphragm 221 to cover central bore 359 of inner piston 308, as shown in FIG. 6B. This causes the residual pressure in the operating fluid present in central bore 359 and conduit 364 to be gradually vented to atmosphere through fixed orifice 123, resulting in pilot valve 120 switching to the position shown in FIG. 4D. This has as its principal result the disconnection of operating fluid or system pressure from the oscillating subcircuit 92 in FIG. 4B, which stops the charging of compression chambers 61', 63'. This state is shown in detail in FIG. 6B.

Turning again to FIGS. 4A–4F, when the system is turned off by depressing switch 107 of valve 110, system pressure is removed from conduit 351 and piston lowering cavity 350, and is diverted due to the resultant switching of pilot valve 112 through conduit 356 to piston raising cavity 355. If $P_2$ is greater than $P_3$ at this time, when pistons 304, 306, and 308 begin raising, as shown in FIG. 6C, diaphragm 221 is deflected and thus moved out engagement with surface 406 such that antechamber 404 is fluidly communicated with vent chamber 295, which is in turn communicated with common inlet chamber 230 of cartridge middle body member 54. After venting occurs in this manner, the pressure of the working fluid downstream of outlet check valves 226, 228 is reduced to near ambient, which eliminates the risk that should point-of-use instrument I be opened, unwanted or accidental flow of working fluid will occur.

Figure 5C:
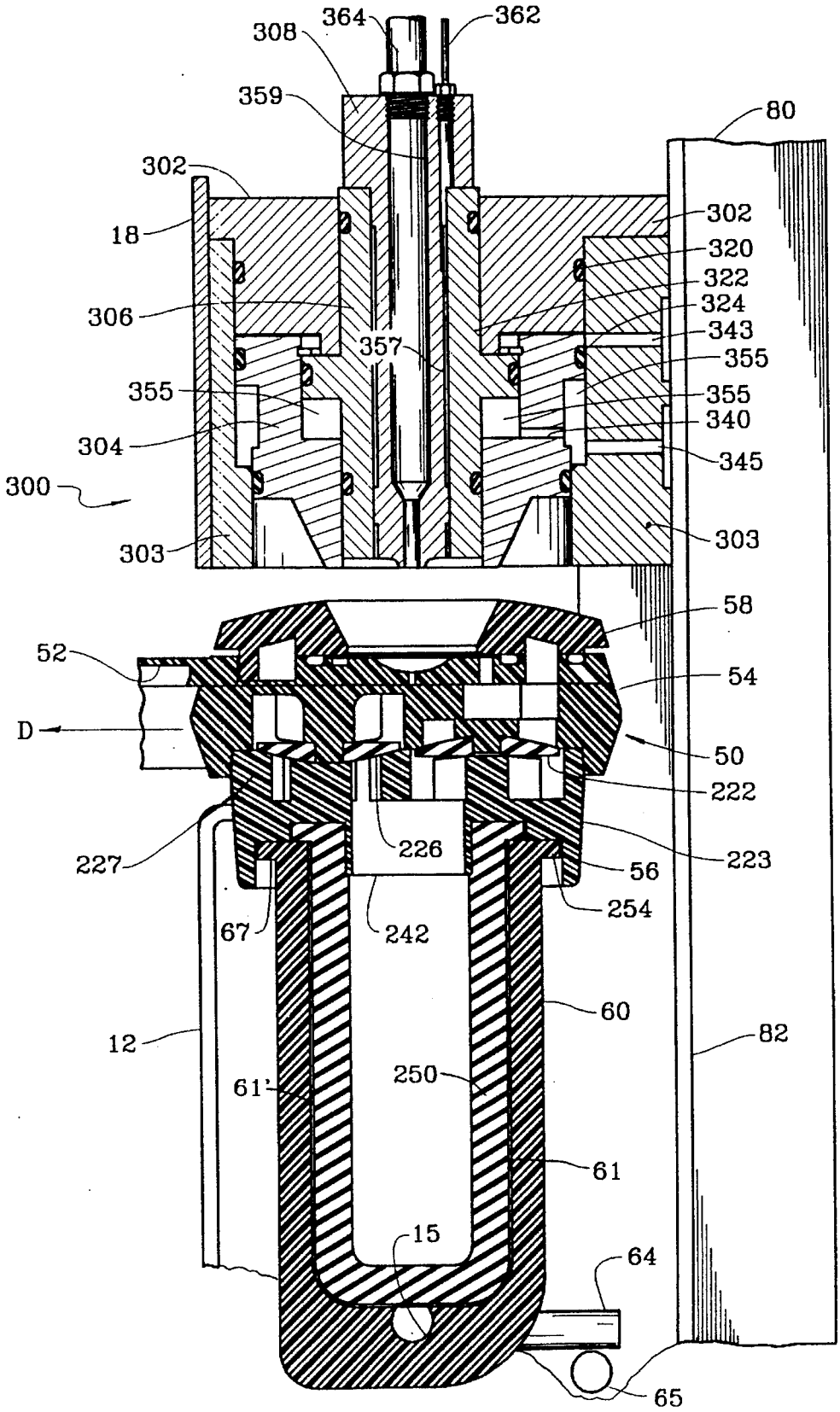
FIG. 5C is a closeup of the area of detail shown in FIG. 5A, where the locking means is in the fully raised position.
Figure 5D:
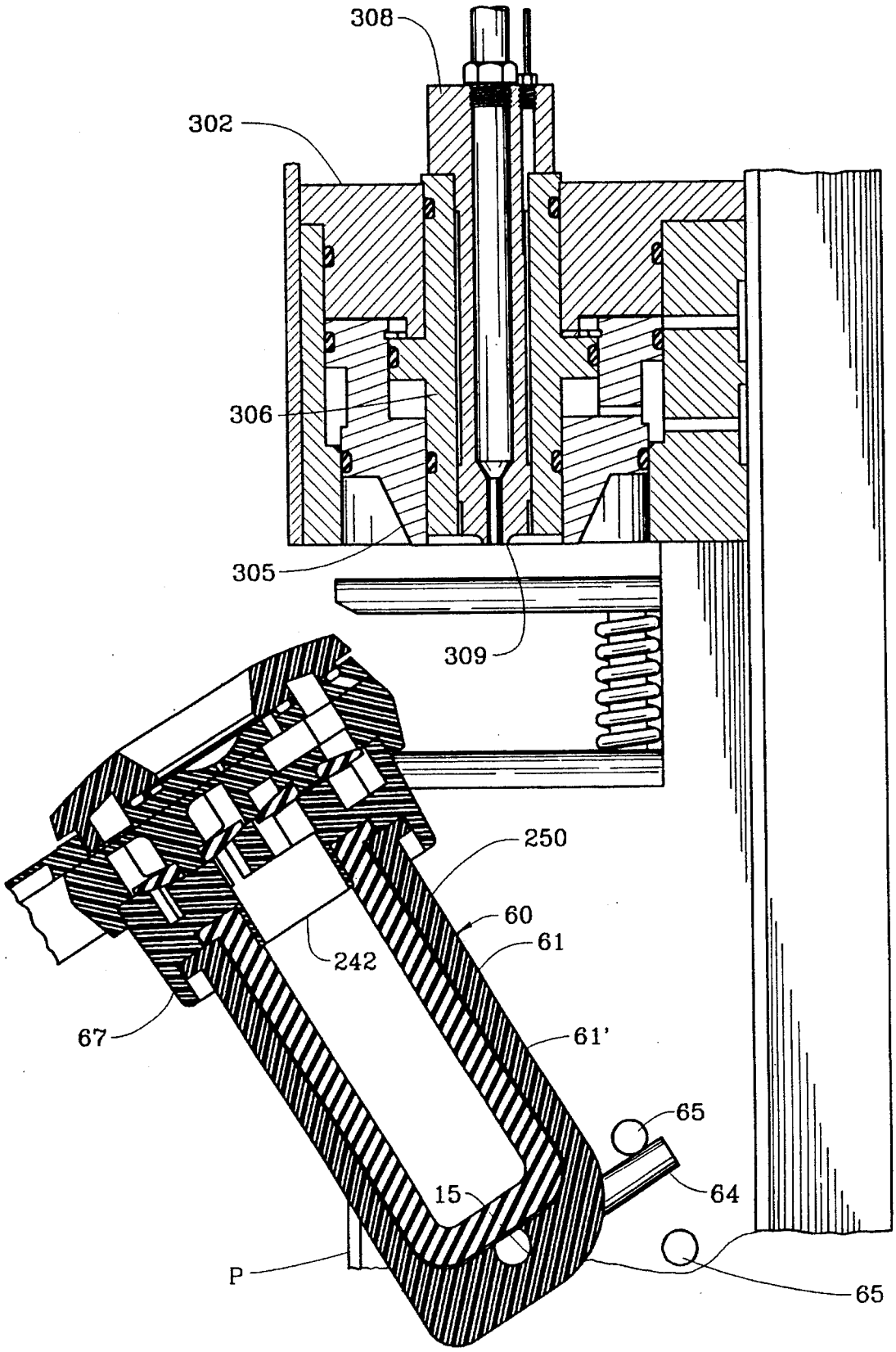
FIG. 5D shows the area of detail shown in FIG. 5B, but where the locking means is raised and the cartridge/bladder and bladder housing unit rotated to the access position.
Figure 5E:
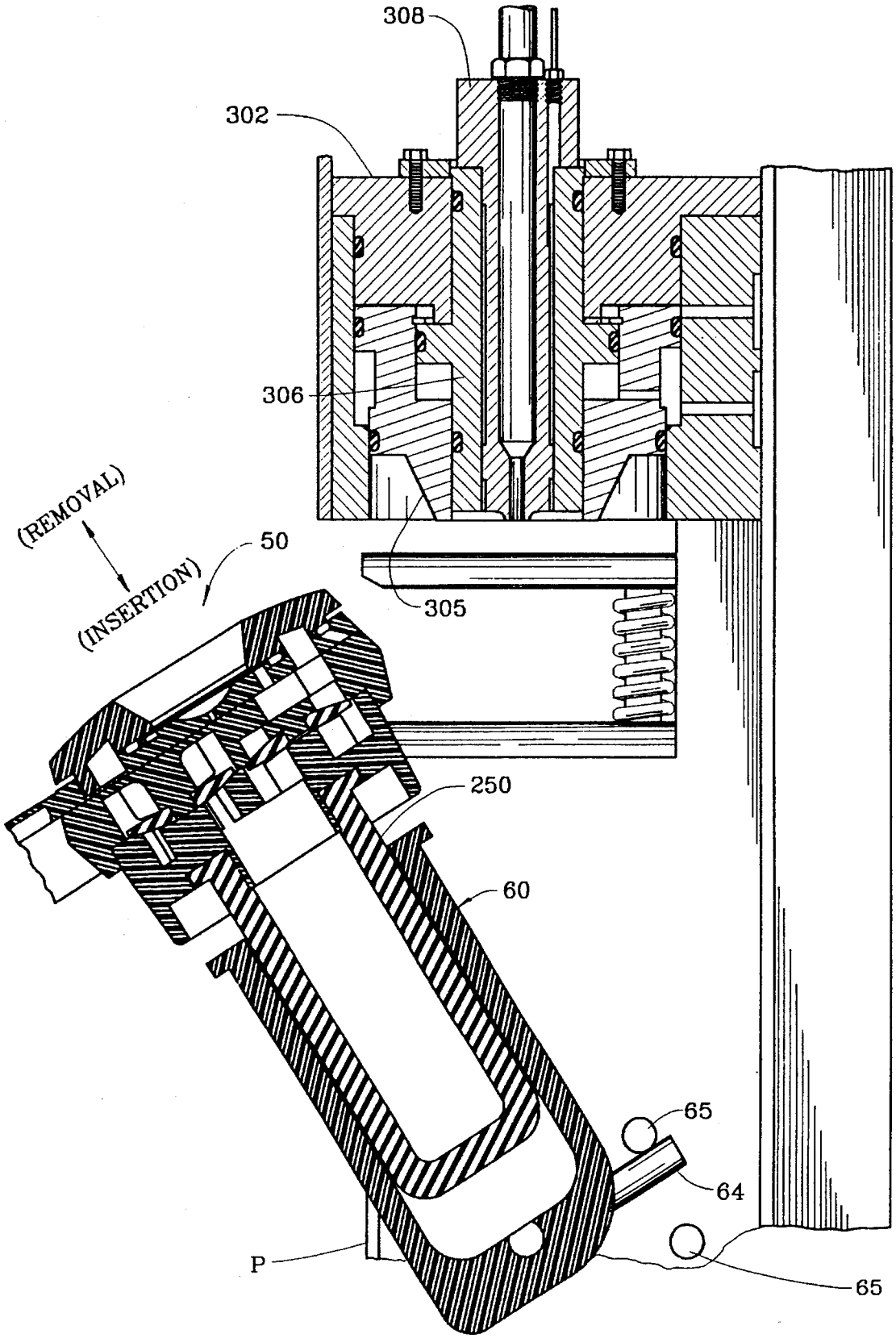
FIG. 5E shows the pump cartridge and pump bladders being removed from the pump.

FIG. 6D shows the locking piston arrangement in its fully raised position, corresponding to the state shown in FIGS. 5C and 5D, wherein the cartridge 50 and bladder housing 60 arrangement may be tilted into the cartridge/bladder removal position.

The pneumatic circuit, which is shown in FIGS. 4A through 4F, is comprised generally of four interconnected manual system control switches 110, 148, 168, and 178, and four interconnected condition-responsive pilot or control valves 120, 130, 140, and 160. Regulator 100 receives a supply of pressurized operating media 72 at pressure $P_I$. The first manual switch, on/off switch 110, is connected to regulator 100 via conduit 73. Means for monitoring pressure in the operating fluid, such as pressure gauge 74, may be used to monitor the pressure in the incoming supply $P_I$ of operating fluid 72.

Regulator 100 sets the maximum system pressure $P_S$, which also limits the bladder compression potential $P_R$ and maintains a constant pressure $P_S$ for the oscillatory subcircuit 92. Switch 110 is comprised of pressure-venting "on" switch 105, pressure-venting "off" switch 107, and four-way, double-vent-piloted valve 112. Valve 112, in the preferred embodiment, is of the type manufactured by Clippard Instrument Laboratory Inc., Cincinnatti, Ohio, model no. R-442, and sold under the trademark MINIMATIC™, having a flow rate of 10 standard cubic feet per minute (scfm) at 100 psi, aminimum pilot pressure of 20 psi, an operating temperature range between 30° and 230° F., working pressure of from zero to 160 psi, and a response time of approximately 10 milliseconds. Valve 112 is comprised of eight ports A, B, C, D, E, F, G, and H as shown in FIG. 4D. Conduit 112z supplies operating fluid through fixed orifi 111, 113 to pilot chambers 112x and 112y. Depressing system "on" switch 105 causes pilot chamber 112y to be vented to ambient through one-way valve 104, which in turn causes the valve to be shifted by pressure present in pilot chamber 112x into the position shown in FIG. 4A. Conversely, depressing system "off" switch 107 causes operating fluid within pilot chamber 112x to be vented to ambient. It is presumed that prior to depressing switch 107, fixed orifice 113 will have allowed the pressure within pilot chamber 112y to become sufficiently elevated such that valve 112 will be shifted to the position shown in FIG. 4D, corresponding to the pump being turned off.

Manual switches 148, 168, and 178 each utilize four-way, double-vent-piloted valves 150, 170, and 180, generally identical to pilot valve 112. Each of switches 148 and 178 utilize manual vent switches 153, 154, and 185, 183 connected to ports D, F thereof, respectively, for venting pilot chambers 150y, 150x, and 180y, and 180x, respectively, as desired. Switch 168 employs a manual switch 173 to vent pilot chamber 170x through port F thereof, whereas port D thereof vents pilot chamber 170y each time either switch 183 or 185 of manual switch 178 is depressed.

Port B of valve 112 is fluidly communicated with piston lowering cavity 350 of locking/unlocking means 300 via conduit 351. Port H of valve 112 is fluidly communicated with piston raising chamber 355 via conduit 356. Port B thereof is also fluidly communicated with valves 120, 150, 170, and 180 via appropriate plumbing shown in FIGS. 4A–4F.

Condition-responsive valve 120 is comprised of a four-way, spring-return, fully-ported, five-port valve, which, in the preferred embodiment, is sold under model no. R-405 by the Clippard Instrument Laboratory, Inc. under the trademark MINIMATIC™. The R-405 pilot valves have a flow rate of 10 scfm at 100 psi, a minimum pilot pressure of 10 psi, operating temperature range of from 30° to 230° F., a working pressure of zero to 150 psi, and a response time of 10 milliseconds.

Condition-responsive oscillatory subcircuit valve 130 is, in the preferred embodiment, a four-way, double-piloted, fully-ported, two-position reset valve with a special air-retracted spring 131 that will return the valve to a definite position when the input fluid supply is turned off, sold under model no. R-412 by the Clippard Instrument Laboratory, Inc. under the trademark MINIMATIC™.

Valves 140 and 160 are, preferably, three-way, two-position, double-piloted, fully-ported valves sold under model no. R-302 by the Clippard Instrument Laboratory, Inc., having a flow rate of 10 scfm at 100 psi, a minimum pilot pressure of 10 psi, operating temperature range from 30° to 230° F., working pressure of zero to 150 psi, and a response time of 10 milliseconds. Pilot chamber 140y is intermittently supplied with pressurized operating fluid via conduit 141 from port B of pilot valve 130. Pilot chamber 140x of valve 140 is supplied with operating fluid through fixed orifice 144 from port H of pilot valve 130 intermittently. One-way valve 142 is disposed in parallel with orifice 144 to permit only reverse flow of operating fluid through conduit 142', thereby forming a fixed orifice flow control valve.

In like manner, pilot chamber 160x of pilot valve 160 is supplied with pressurized operating fluid via conduit 161 intermittently from port B of valve 130 through fixed orifice 164. One-way valve 163 is disposed in parallel with orifice 164 to permit only reverse flow of operating fluid through conduit 162. Pilot chamber 160y is supplied intermittently with operating fluid from port H of pilot valve 130 through port D of valve 160.

Pilot chamber 130y of valve 130 is intermittently pressurized from port B of valve 130 via conduit 141 through a series of fixed orifi 134, 139, adjustable orifice 138, and one-way valve 133. Orifi 138 and 139 are in series with each other and in parallel with both fixed orifice 134 and one-way valve 133. One-way valve 133 and fixed orifice 134 comprise a fixed orifice flow control valve. Pilot chamber 130x is supplied with pressurized operating fluid from port H of valve 130 via conduit 137' intermittently through fixed orifice 137 and port F of that same valve. One-way valve 136 is placed in parallel therewith to permit reverse flow of operating fluid through conduit 136', thereby forming a fixed orifice flow control valve. Spring 131 is air-retracted when operating fluid is present in conduit 131', in which case valve 130 functions normally as a double-piloted, four-way valve, as well known in the art.

Port B of pilot valve 112 is also in fluid communication with a second regulator 76, which may be adjustable, and which is connected in fluid communication with large accumulator 125. Accumulator 125 feeds node 501 and port A of valve 150. A pressure gauge 126 may be employed to monitor operating fluid pressure $P_R$ downstream of regulator 76. A smaller accumulator 124 may be employed to provide a uniform operating fluid pressure in conduit 129 downstream of port H of valve 120.

Figure 21:
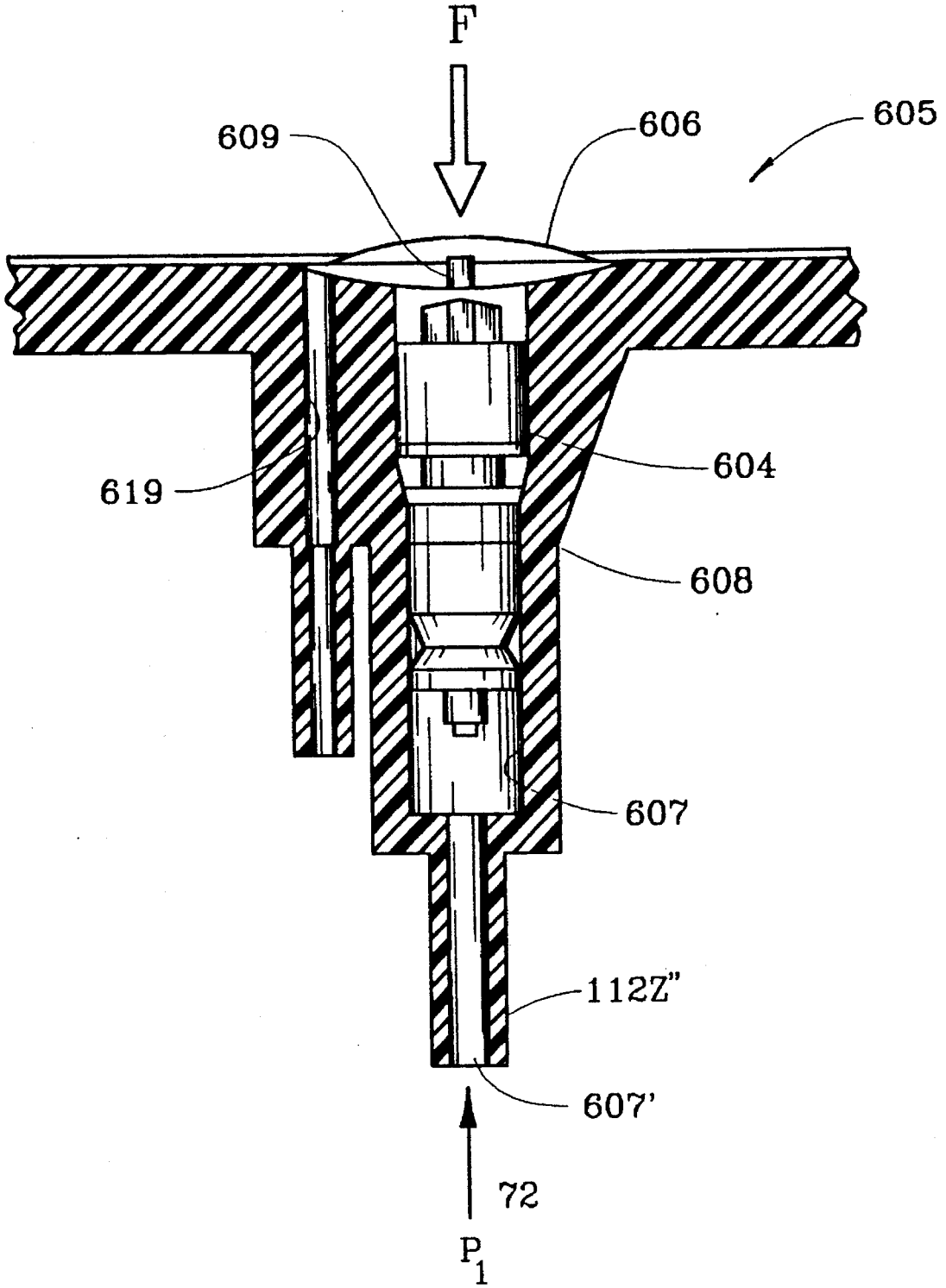
FIG. 21 is a cross sectional view of a preferred embodiment of a tactile switch adaptable for use with the instant invention.

The system "on" and system "off" switches 105, 107 should be suitable two-way, normally closed switches. Thus, when the system "on" switch 105 is engaged, the source of pressurized operating fluid 72 is communicated to the rest of the pneumatic circuit 90. Switches 105, 107, 153, 154, 173, 183, and/or 185 may be comprised of any of the known pneumatic high-speed panel switches. Alternatively, said switches may be of the type shown in FIG. 21. FIG. 21 shows a first embodiment of a one-way or check valve 605 which is comprised of a check valve member 604, which may be similar structurally to a common tire valve, disposed within an inlet chamber or channel 607 defined by housing 608. A flexible tactile cover 606 is placed in close association with stem 609. Depressing cover 606 with force F causes cover 606 to deflect downwardly and axially displace stem 609, fluidly communicating pressurized operating fluid present in inlet chamber 607 with outlet chamber 607'. Preferably, outlet chamber 607' is fluidly communicated with the ambient.

The valves 130, 140, and 160 are condition-responsive and are interconnected in such a way that the pumping frequency can be varied.

Small accumulator 124 is connected to conduit 129 to provide a uniform flow of pressurized operating fluid used to charge pilot chambers 140x, 140y, 160x, and 160y. Second accumulator 125 may be used to provide a uniform operating fluid pressure used to charge compression chambers 61' and 63', as well as to provide a stable reference pressure $P_3$ fed to annular volume 357 of locking/unlocking means 300. Reference pressure $P_3$ may be adjusted by varying the setting of second regulator 76.

Because working fluid from supply reservoirs 198, 199 are fed into a common inlet chamber 230 of cartridge 50, it is possible to utilize one of sources 198, 199 at a time. To achieve that result, working fluid pneumatic cutoff rams 191, 193, respectively, are employed to cause clamping jaw 192 to squeeze working fluid supply conduit 211 against upper clamping jaw 210 with respect to working fluid supply 198. Pneumatic ram 193 may be energized to cause lower clamping jaw 194 to squeeze working fluid supply conduit 213 against upper clamping jaw 212 to deprive cartridge 50 of working fluid from supply 199. Switches 168 and 178 are utilized to control pneumatic rams 191, 193. By depressing manual switch 185, it can be seen that valve 180 will be placed in the position shown in FIG. 4F communicating ports A and B. This will, in turn, cause valve 170 to be moved into the position shown in FIG. 4F because pressurized operating fluid in pilot chamber 170y will be vented to ambient through check valves 176 and 184. When this occurs, operating fluid will be supplied to ram 193, which will in turn close off supply conduit 213 and thus supply 199 leaving only supply 198. Conversely, if switch 183 is depressed, valve 180 will assume the position opposite to that shown in FIG. 4F, in which case pilot chamber 170y of valve 180 will again be vented to ambient, wherein ports A and H of valve 180 are communicated. Since depressing switch 183 vents pilot chamber 180x of valve 180, valve 180 will be switched so that operating fluid is supplied to port H of valve 180, passed through conduit 191', to ram 191. This, in turn, will clamp supply conduit 211 and deprive cartridge 50 of working fluid from reservoir 198. The third mode governed by switches 168 and 178 is brought about by depressing switch 173, which moves valve 170 into the position opposite to that shown in FIG. 4F, which, in turn, deprives port B of valve 180 of operating fluid such that neither ram 191 nor 193 can be pressurized. Jaws 192, 210, and 194, 212 are normally separated by virtue of compression springs 196, 197 as shown in FIG. 7.

Figure 19:
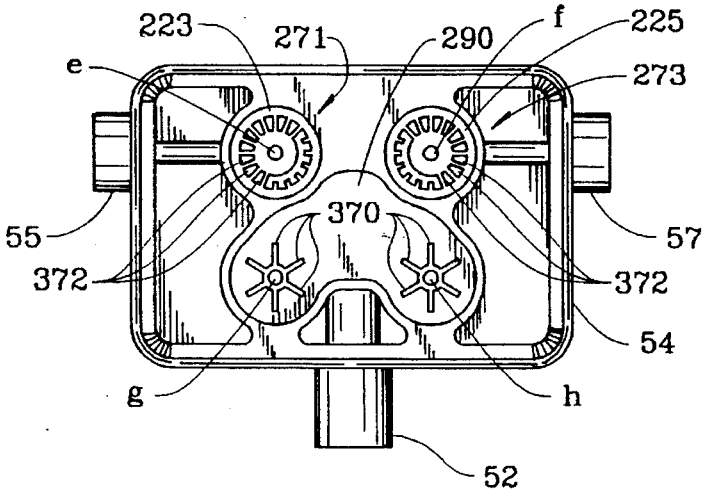
FIG. 19 is a bottom plan view of middle body member 54 of the pump cartridge of the instant invention.

In order to obtain a continuous flow of working fluid through discharge orifice 52 of cartridge 50, it is necessary to alternatively, but in overlapping fashion, charge compression chambers 61' and 63'. To accomplish this, switch 105 is depressed and switch 153 also depressed to respectively turn pump P on and place valve 150 in the continuous flow position, i.e. the mode shown in FIG. 4E. As a result of depressing switch 105, pilot valve 110 moves to the position shown in FIG. 4D, wherein pressurized operating fluid is supplied to node 119. It can be seen that operating fluid is thereby provided to second regulator 76, large accumulator 125, and annular chamber 357 of locking means 300. Consequently, diaphragm 211 is deflected downwardly away from inner piston nose 309 because $P_3>P_2$, FIG. 6A, permitting operating fluid to be communicated via conduit 364 with pilot chamber 120y of valve 120. As a result, pressurized operating fluid is supplied to small accumulator 124, pilot chamber 131', and port C of valve 130. Upon charging of pilot chamber 131', spring 131 is compressed and permits valve 130 to behave as an ordinary four-way, double-piloted valve, as described above. At this time, pilot chamber 140y of valve 140 becomes pressurized, and pilot chamber 160x of valve 160 begins to become pressurized through orifice 164. In addition, pilot chamber 130y of valve 130 begins to become pressurized through orifi 134, 138, and 139. Pressurization of pilot chamber 140y causes valve 140 to assume a position in which port A thereof is fluidly communicated with port B resulting in pressurized operating fluid being supplied to compression chamber 63', collapsing bladder 252 and ejecting working fluid therefrom, deflecting check valve 228 in FIG. 13, and passing into discharge chamber 290 of cartridge 50, as depicted in FIG. 19.

Turning again to FIGS. 4A–4F, while compression chamber 63' is being charged, pilot chamber 130y becomes fully charged and shifts valve 130 so that ports A and H are communicated together. This results in operating fluid being communicated from port H of valve 130 to pilot chamber 140x of valve 140 and pilot chamber 160y of valve 160. Because of the presence of flow restrictor 144, pilot chamber 140x does not immediately come up to full pressure such that valve 140 is not immediately shifted to its second position. However, due to the absence of any flow restrictor upstream of pilot chamber 160y, valve 160 is immediately shifted to its second position, such that large accumulator 125 is communicated through valve 150 to port A of valve 160, and then through valve 160 to port B thereof and on to pump chamber 61', causing bladder 250 to collapse at least partially, ejecting working fluid therefrom past check valve 226 and into chamber 290. While that is occurring, pilot chamber 140y is vented to ambient because when valve 130 is in its second position, port B thereof is communicated directly with port A thereof. Likewise, pilot chamber 160x is vented to ambient virtually instantaneously through check valve 163 when valve 130 is shifted to its second position. It should be noted that check valves 133 and 136 also permit the virtually instantaneous discharging of pilot chambers 130y, 130x, respectively, upon switching of valve 130 from one position to the other. Because orifice 138 is adjustable, the fill rate of pilot chamber 130y can be varied by the operator of the pump. Varying the fill rate of pilot chamber 130y varies the rate at which valve 130 oscillates, which in turn varies the rate at which valves 140 and 160 oscillate. As can be seen in FIGS. 4A through 4F, since the frequency of oscillation of valves 140 and 160 is directly proportional to the frequency of charging of compression chambers 63', 61', slowing the fill rate of pilot chamber 130y has the effect of slowing the rate of oscillation of valve 130, and this has the effect of slowing down the frequency at which pump chambers 61' and/or 63' are charged or pressurized. Conversely, increasing the rate at which pilot chamber 130y is filled has the effect of increasing the frequency at which compression chambers 61' and/or 63' are charged. The rate at which pilot chamber 130y is filled is varied by adjusting knob 138', which controls the rate at which operating fluid can pass through variable orifice 138.

Any other type of switching valve may be used in place of valves 112, 120, 130, 140, 150, 160, 170, or 180, so long as the valve selected satisfies the requirements of having high speed switching capability, minimal blow-by, and performing accurately.

When pulsed flow is desired, switch 154 is depressed, which disconnects port A of valve 160 from large accumulator 125 and hence deprives compression chamber 61' of operating fluid, regardless of the position of valve 160. With that exception, oscillating subcircuit 92 functions in the same manner in the pulse flow mode as in the continuous flow mode described above.

Figure 8A:
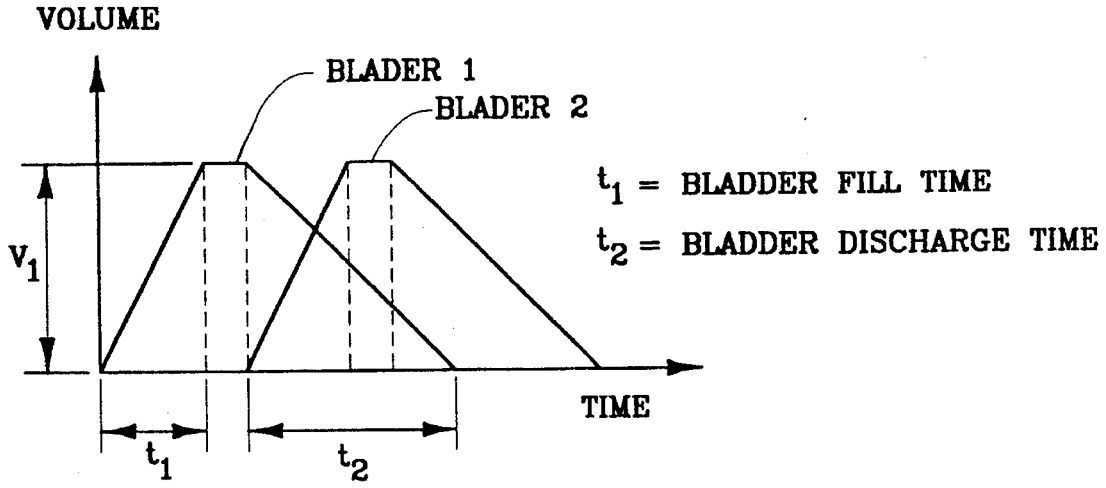
FIG. 8A is a graphic illustration of the cyclic overlap of the volume of working fluid within the first and second pump bladders during the continuous or smooth flow mode.

FIG. 8A shows an approximation of the overlap of the pump cycles of pump bladders 250, 252 in the continuous flow mode, where the flow of working fluid emanating from point-of-use instrument I appears smooth or continuous, even though it is being produced by completely independent, pulsing, pumping compartments.

Figure 8B:
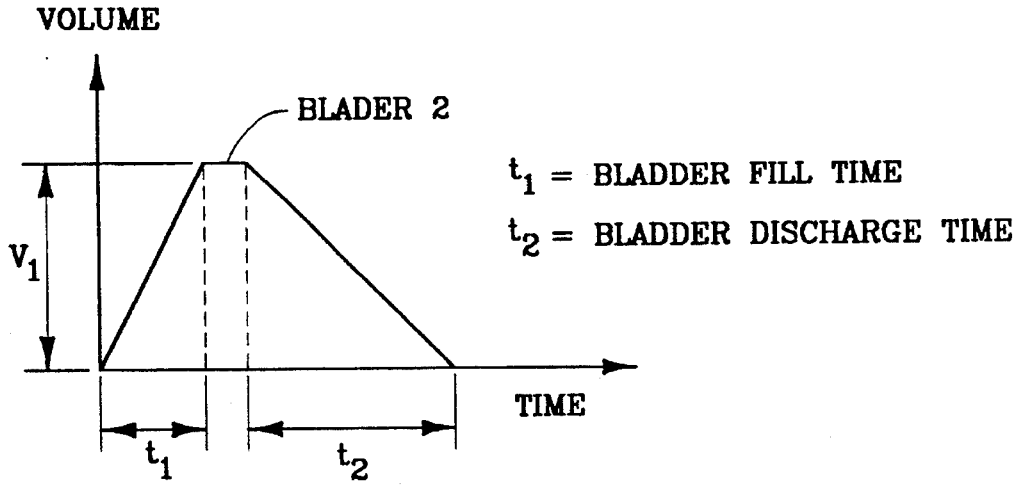
FIG. 8B is a graphic illustration of the cyclic action of the second pump bladder during the pulsatile flow mode.

FIG. 8B shows an approximation of the fill, delay, and discharge cycle of pump bladder 252 when pump P is in the pulse flow mode. To enter the pulse flow mode, pulse flow switch 154 is depressed, venting pilot chamber 150x to ambient, thereby disconnecting system pressure from port A of pilot valve 160. This has the effect of discommunicating system pressure from pump chamber 61'.

It can be seen from FIGS. 8A and 8B that the fill time of each bladder 250, 252 is somewhat shorter than the discharge time thereof. This feature allows for a smooth transition from bladder 250 to bladder 252 and back to bladder 250, etc., when pump P is in the continuous flow mode. Thus, there is an overlap between the discharge portion of the pumping cycle for one bladder with the bladder filling portion of the pumping cycle of the other bladder. Obviously, the fill, delay, and discharge aspects of the pump cycle may be varied to achieve any desired flow of working fluid. In addition, more than two pump chambers may be used, and the overlap or non-overlap thereof made to conform to the particular application.

Figure 9:
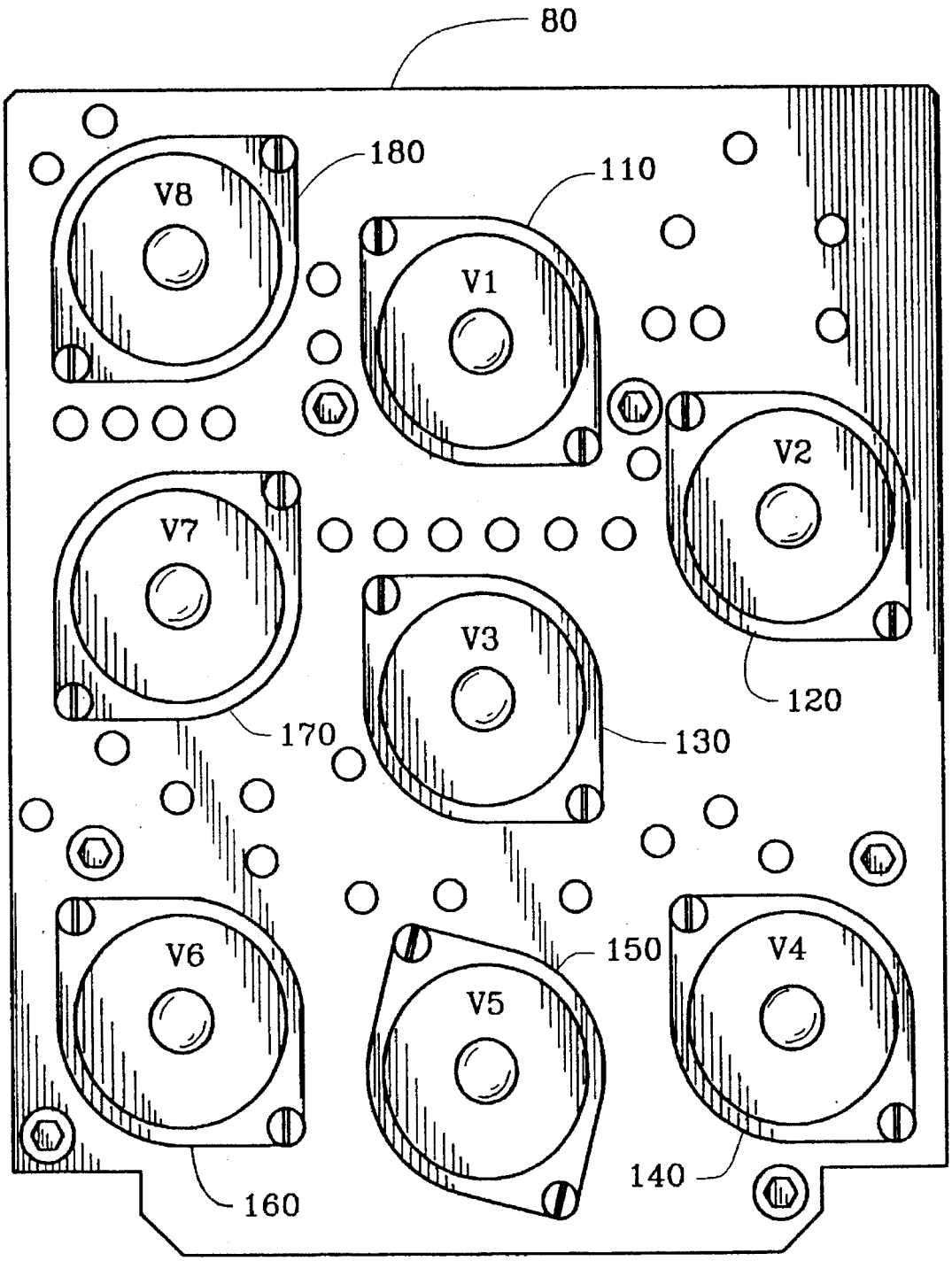
FIG. 9 is a front elevational view of the pneumatic circuit manifold and pilot valves of the instant invention.
Figure 10:
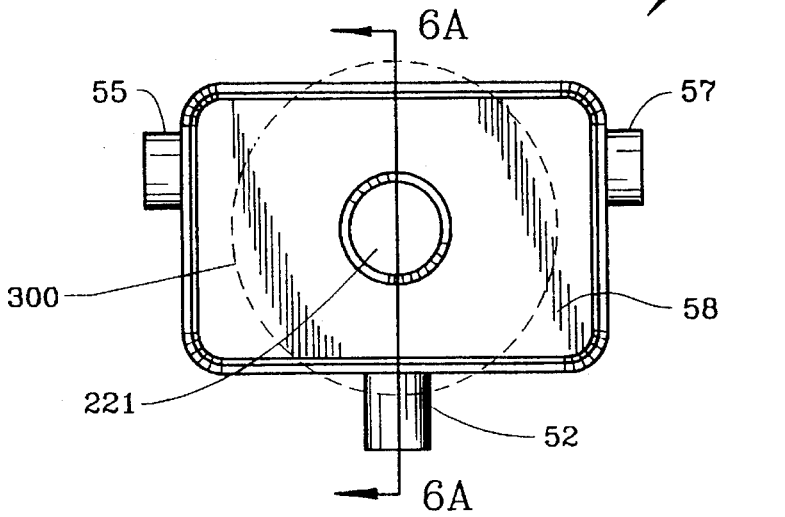
FIG. 10 is a top plan view of the pump cartridge used with the invention.
Figure 11:
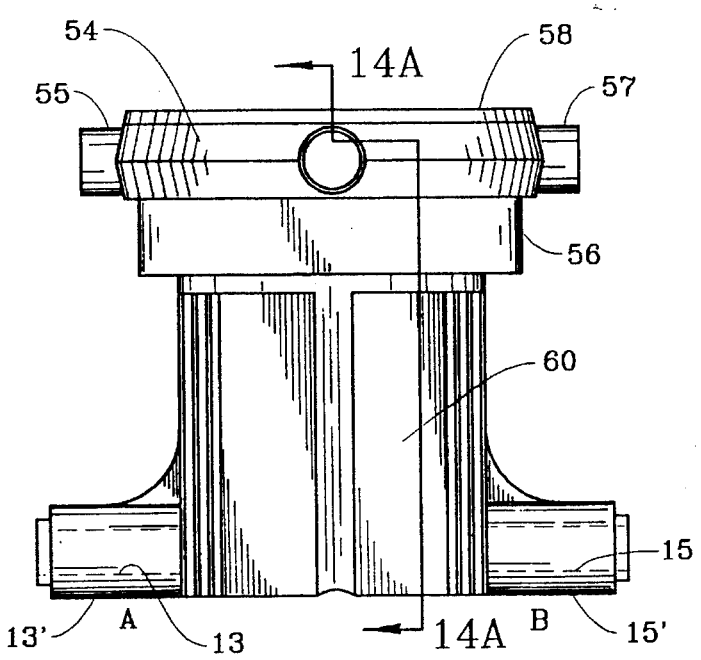
FIG. 11 is a front elevational view of the pump cartridge and bladder housing body member.
Figure 12:
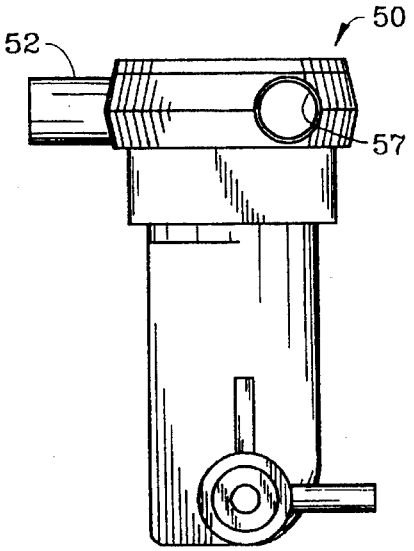
FIG. 12 is a right side elevational view of the pump cartridge and first bladder housing.

The pilot valves of the instant invention may be interconnected using flexible conduit or may all be connected to a common manifold 80 shown in FIGS. 5A, 5B, and 9, and interfaced with one another thereby, and/or through the use of exterior conduits. A manifold cover plate 82 is used in the preferred embodiment to seal manifold 80 and communicate with ports 343 and 345 of locking means 300.

FIG. 5A shows an embodiment of an exhaust noise-damping arrangement, wherein operating fluid which is vented to ambient through any of valves 130, 140 (not shown), or 160 is diverted via manifold 80 into the interior of stand 20 (not shown). Stand 20 is hollow, and, preferably, is lined with any well known acoustical damping material, such as foam rubber or the like.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A variable pneumatic pulsatile pump comprising:

a pump means including at least two pneumatically independent compression chambers independently and fluidly communicating with a supply of pressurized operating fluid;

a pneumatic control circuit in fluid communication with said pump means for controllably communicating said pump means with said pressurized operating fluid so as to variably and selectively supply and deprive said compression chambers with said pressurized operating fluid; and at least one supply of working fluid to be selectively admitted to and ejected from said pump means in response to said pneumatic control circuit.

2. The pump of claim 1, wherein said pneumatic control circuit is comprised of:

a means for supplying said compressed operating fluid independently to said at least two compression chambers from a single supply of compressed operating fluid; and means for alternatingly supplying and depriving said means for supplying with pressurized operating fluid, switchable between a first, flow, state when working fluid is being discharged from said pump means and a second, no-flow, state when working fluid is not being discharged from said pump means.

3. The pump of claim 2, wherein said means for supplying is comprised of an oscillatory sub-circuit, the oscillation rate of which is adjustable.

4. The pump of claim 2, wherein said means for alternatingly supplying and depriving includes a pilot valve.

5. The pump of claim 2, further comprising sensing means responsive to the difference in pressure within the pressurized operating fluid and the pressure within the working fluid downstream of said pump means, said sensing means being fluidly communicated with said means for supplying and depriving.

6. The pump of claim 5, further comprising means for disconnecting at least one of said compression chambers from said pressurized operating fluid while said pump is in use.

7. The pump of claim 6, wherein said means for disconnecting includes at least one pilot valve.

8. The pump of claim 6, wherein working fluid is supplied to said pump means from at least two independent sources, the pump further comprising:

means for switching between working fluid supplies, such that working fluid can be supplied to the pump means exclusively from a first supply thereof, or, alternatively, exclusively from a second supply thereof, etc., or, further alternatively, from more than one supply thereof at one time.

9. The pump of claim 8, wherein said means for switching includes at least one pilot valve.

10. A pneumatic pump element, comprising:

at least two pneumatically independent compression chambers;

a plurality of compressible bladders, one associated with each compression chamber adapted to receive and eject a quantity of working fluid;

a pump cartridge communicating each bladder with at least one supply of working fluid; and means for selectively supplying compressed operating fluid to each compression chamber to selectively compress any one of said bladders to cause working fluid to be ejected through a discharge of said cartridge.

11. The pump of claim 10, further comprising:

first means for preventing reverse flow of working fluid from said bladders toward an inlet of said cartridge;

second means for preventing reverse flow of working fluid from a discharge defined by said cartridge into said bladders; and a resilient diaphragm isolating said cartridge discharge from said cartridge inlet when in a first, sealing, position and allowing communication between said cartridge discharge and said cartridge inlet when in a second, venting, position.

12. The pump of claim 11, wherein said pump cartridge is comprised of a lower body member adapted to mate with at least a portion of said compressible bladders, a middle body member defining said cartridge inlet and said cartridge outlet, and an upper body member adapted to sandwich said diaphragm against said middle body member.

13. The pump of claim 11, wherein said means for preventing reverse flow of working fluid from said bladders to said working fluid sources are each comprised of at least one one-way check valve corresponding to each bladder, and said means for preventing reverse flow of working fluid from said cartridge discharge to said bladders are each comprised of at least one one-way check valve corresponding to each bladder.

14. The pump of claim 13, further comprising means communicating the cartridge discharge with the cartridge inlet when the diaphragm is in the venting position.

15. The pump of claim 14, wherein said means communicating the cartridge discharge with the cartridge inlet is a fluid flow passageway defined by the cartridge.

16. An infinitely variable pneumatic pulsatile pump, comprising:

a housing;

a pneumatic control circuit associated with said housing;

means for controlling the function of said circuit associated with said housing;

a pump inlet/outlet cartridge;

at least two pneumatically independent compression cylinders, each defining its own compression chamber, each said compression chamber being fluidly communicated with said pneumatic circuit;

a plurality of compressible bladders, one associated with each of said compression chambers, each said bladder defining a working fluid receiving interior volume fluidly communicated with said cartridge;

each said cylinder being pivotally connected to said housing between a first, use, position, and a second, cartridge/bladder removal, position;

means for locking said cartridge and cylinders into the use position reciprocally movable with respect to said housing between a first, cartridge/bladder locking, position, and a second, cartridge/bladder release, position;

said pneumatic circuit being fluidly communicated with a supply of pressurized operating fluid; and said pneumatic circuit selectively, but controllably communicating said pressurized operating fluid with said compression chambers to at least partially collapse said bladders and thereby eject working fluid from said cartridge as desired.

17. The pump of claim 16, wherein said pneumatic circuit is adjustable so as to cause working fluid to be ejected from said cartridge in a pulsating flow, or to cause working fluid to be ejected in a smooth flow, or any combination thereof.

18. The pump of claim 17, wherein said means for locking is comprised of:

a piston/cylinder arrangement defining a piston lowering volume and a piston raising volume, said piston being movable relative to said cylinder between the cartridge/bladder locking position and the cartridge/bladder release position by the introduction of pressurized operating fluid into either the piston lowering volume or the piston raising volume, respectively.

19. The pump of claim 18, wherein:

said cartridge defines an inlet chamber fluidly communicated with a source of working fluid via at least one cartridge inlet passageway;

said cartridge further defining an outlet chamber fluidly communicated with a point-of-use instrument means via a cartridge discharge passageway;

said cartridge inlet and outlet chambers being fluidly communicated with the interior of each of said bladders via inlet and outlet working fluid passageways, respectively;

at least one check valve means disposed across each working fluid passageway so that working fluid is permitted to flow only from the cartridge inlet into each bladder interior in one direction, and thereafter ejected upon compression of said bladders through said outlet working fluid passageways toward said cartridge outlet chamber;

said inlet and outlet chambers being selectively fluidly communicated with each other via a pressure release passageway; and a resilient diaphragm means normally sealing said pressure release passageway.

20. The pump of claim 19, wherein said piston arrangement of said locking means defines a sensor nose adapted to contact said diaphragm when working fluid pressure in the discharge chamber of said cartridge is greater than the operating fluid pressure present at said sensor nose, under which condition compressed operating fluid is prevented from entering any of said compression chambers.

* * * * *